US011486224B2

(12) United States Patent
Honeker et al.

(10) Patent No.: US 11,486,224 B2
(45) Date of Patent: Nov. 1, 2022

(54) SENSOR CONTROLLED DOWNHOLE VALVE

(71) Applicant: Oracle Downhole Services Ltd., Nisku (CA)

(72) Inventors: Levi Honeker, Nisku (CA); Mahlon Lisk, Nisku (CA)

(73) Assignee: Oracle Downhole Services Ltd., Nisku (CA)

( * ) Notice: Subject to any disclaimer, the term of this patent is extended or adjusted under 35 U.S.C. 154(b) by 0 days.

(21) Appl. No.: 17/203,478

(22) Filed: Mar. 16, 2021

(65) Prior Publication Data

US 2021/0198975 A1 Jul. 1, 2021

Related U.S. Application Data

(63) Continuation of application No. 16/380,888, filed on Apr. 10, 2019, now Pat. No. 10,961,819.
(Continued)

(51) Int. Cl.
*E21B 34/06* (2006.01)
*E21B 47/06* (2012.01)
*E21B 47/07* (2012.01)

(52) U.S. Cl.
CPC ..... *E21B 34/066* (2013.01); *E21B 47/06* (2013.01); *E21B 47/07* (2020.05)

(58) Field of Classification Search
CPC ..... E21B 34/066; E21B 34/142; E21B 34/14; E21B 47/06; E21B 47/07; E21B 23/04; E21B 23/0413; E21B 4/04; E21B 4/12
See application file for complete search history.

(56) References Cited

U.S. PATENT DOCUMENTS 5,273,112 A 12/1993 Schultz
5,937,945 A 8/1999 Bussear et al.
(Continued)

FOREIGN PATENT DOCUMENTS

CA 2856184 A1 1/2015
CA 2873541 A1 6/2015
(Continued)

OTHER PUBLICATIONS

International Search Report and the Written Opinion of the Canadian Intellectual Property Office for PCT Patent Application No. PCT/CA2019/050439 dated Jul. 2, 2019.

*Primary Examiner* — David Carroll
(74) *Attorney, Agent, or Firm* — Park, Vaughan, Fleming & Dowler LLP; Shane Nelson

(57) ABSTRACT

The present disclosure provides a valve assembly comprising a valve section, a power section, and an electronics section. The valve assembly is configured to mate with a tubing sub (and/or mandrel) inserted in-line with a tubing string inserted into a wellbore. The valve allows for injection into or production from the tubing string. The valve assembly comprises an electric motor and a motor controller permitting fine control over the valve, as well as sensors which measure various parameters, such as fluid flow, valve position, pressure, temperature, and/or water cut. A cable connects the valve assembly to the surface and provides power and data telemetry and allows control of the valve assembly with a remote electronic signal. Multiple valve assemblies may be provided at spaced intervals along the tubing string and individually monitored and/or controlled by a remote location. Also disclosed is a method for operation of such valve assemblies.

44 Claims, 13 Drawing Sheets

Related U.S. Application Data

(60) Provisional application No. 62/657,525, filed on Apr. 13, 2018.

(56) References Cited

U.S. PATENT DOCUMENTS

| | | | | |
|---|---|---|---|---|
| 6,070,608 | A | 6/2000 | Pringle | |
| 6,435,282 | B1 | 8/2002 | Robison et al. | |
| 6,715,550 | B2 | 4/2004 | Vinegar et al. | |
| 6,758,277 | B2 | 7/2004 | Vinegar et al. | |
| 6,776,240 | B2 | 8/2004 | Kenison et al. | |
| 6,840,321 | B2 * | 1/2005 | Restarick | E21B 41/0035 166/313 |
| 6,863,126 | B2 * | 3/2005 | McGlothen | E21B 41/0042 166/313 |
| 6,951,252 | B2 * | 10/2005 | Restarick | E21B 34/08 166/117.6 |
| RE39,583 | E | 4/2007 | Upchurch | |
| 7,387,165 | B2 | 6/2008 | Lopez de Cardenas et al. | |
| 8,186,444 | B2 | 11/2012 | Patel | |
| 8,752,629 | B2 | 6/2014 | Moen | |
| 8,905,128 | B2 | 12/2014 | Niconoff | |
| 8,905,139 | B2 | 12/2014 | Arizmendi, Jr. et al. | |
| 9,228,402 | B2 | 1/2016 | Strilchuk | |
| 9,228,423 | B2 | 1/2016 | Powell et al. | |
| 9,291,033 | B2 | 3/2016 | Scott et al. | |
| 9,316,076 | B2 | 4/2016 | Longfield et al. | |
| 9,453,389 | B2 | 9/2016 | Anderson et al. | |
| 9,896,906 | B2 | 2/2018 | Tunkiel et al. | |
| 9,903,182 | B2 | 2/2018 | Getzlaf et al. | |
| 9,970,262 | B2 | 5/2018 | Werries et al. | |
| 10,066,467 | B2 | 9/2018 | Getzlaf et al. | |
| 10,280,708 | B2 | 5/2019 | Lamb et al. | |
| 10,323,481 | B2 | 6/2019 | Pratt et al. | |
| 10,443,344 | B2 | 10/2019 | Vasques et al. | |
| 10,480,284 | B2 * | 11/2019 | Watson | E21B 43/12 |
| 2004/0055752 | A1 * | 3/2004 | Restarick | E21B 34/08 166/117.6 |
| 2012/0043092 | A1 * | 2/2012 | Arizmendi, Jr. | E21B 34/06 166/330 |
| 2015/0060084 | A1 | 3/2015 | Moen et al. | |
| 2016/0061004 | A1 | 3/2016 | Tunkiel et al. | |
| 2017/0336811 | A1 | 11/2017 | Stone et al. | |
| 2018/0020229 | A1 | 1/2018 | Chen et al. | |
| 2018/0202269 | A1 * | 7/2018 | Wensrich | E21B 34/16 |
| 2019/0085658 | A1 | 3/2019 | Reid | |
| 2019/0235007 | A1 | 8/2019 | Williamson et al. | |

FOREIGN PATENT DOCUMENTS

| | | | |
|---|---|---|---|
| CA | 2906464 | A1 | 3/2016 |
| CA | 2916168 | A1 | 6/2016 |
| CA | 3017294 | A1 | 9/2016 |
| CA | 2927973 | A1 | 10/2016 |
| CA | 2948249 | A1 | 5/2017 |
| CA | 2991729 | A1 | 7/2018 |
| CA | 2996116 | A1 | 8/2018 |
| CA | 2923662 | C | 10/2018 |
| EP | 1234100 | B1 | 2/2005 |
| WO | 2017204654 | A1 | 11/2017 |
| WO | 2019148279 | A1 | 8/2019 |

* cited by examiner

SENSOR CONTROLLED DOWNHOLE VALVE

The present application is a continuation of U.S. application Ser. No. 16/380,888, filed on Apr. 10, 2019, which claims priority to U.S. provisional patent application No. 62/657,525, filed on Apr. 13, 2018. The entire contents of each of the above documents is incorporated herein by reference.

BACKGROUND OF THE INVENTION

Field of the Invention

The present invention relates to a valve for use to produce wellbore fluids in a tubing string and to inject fluids into a wellbore.

Description of the Related Art

In the oil and gas industry, downhole valves are used as part of a tubing string to permit fluid communication between the formation or reservoir through which a wellbore intersects. Such valves may be used to produce fluids into the tubing string, which may be lifted to the surface using natural reservoir pressure or artificial lift solutions. Downhole valves may also be used to inject fluids into the wellbore or the annulus between the well casing and production tubing. Injected fluids can include chemicals to enhance oil recovery or stimulation fluids such as demulsifiers, corrosion inhibitors, scale inhibitors, or paraffin inhibitors. The various chemicals and their intended effects are well known in the industry.

Mechanically actuating downhole valves and controlling them to control their opening and closing are non-trivial issues, and many different solutions have been proposed and implemented in the art. Potential solutions must accommodate harsh downhole conditions, dimensional limitations imposed by tubing size, and other known difficulties. In general, conventional downhole valves are based on hydraulics and do not use control sensors to drive the position of the valve inlet/outlet; conventional valves are partially (or fully) opened or closed by hydraulic control lines from the downhole valve and the surface. Conventional valves present numerous problems. For example, a conventional hydraulic valve requires a separate control line from the wellhead to each downhole valve, which practically limits the number of downhole valves possible. Another problem includes complicated wellhead exits due to the number of control lines used in a well. Further, deep wells require increased surface pressure to actuate downhole valves, which becomes a safety hazard. Still further, if one return line is used for all downhole valves, if it fails, all the lines fail and/or all downhole valves are rendered inoperable.

There are existing technologies that relate to a downhole valve. See, e.g., U.S. Pat. Nos. 9,903,182; 9,970,262; 10,066,467; and U.S. Patent Publication No. 2018/0171751, incorporated herein by reference. As another example, Schlumberger offers a production system named Manara. The Manara system utilizes a single control line that connects multiple downhole valves. However, the Manara product uses wellbore pressure to actuate the control valve, which is large and expensive.

A need exists for an improved method and system for remotely actuating, controlling, and/or monitoring of a downhole valve and the associated fluid flows through the valve. A need exists for an improved method and system for the actuation, control, and/or monitoring of a plurality of downhole valves using a single control line. A need exists for a way to drive the position of a downhole valve besides using hydraulics. A need exists for an improved method and system for enhanced oil recovery and/or artificial lift applications.

SUMMARY OF THE INVENTION

The present disclosure provides a valve assembly comprising a valve section, a power section, and an electronics section. The valve assembly is configured to mate with a tubing sub (and/or mandrel) inserted in-line with a tubing string inserted into a wellbore. The valve assembly comprises a motor and a motor controller permitting fine control over a valve opening, as well as sensors which measure various parameters, such as fluid flow, valve position, pressure, temperature, and/or water cut. A cable connects the valve assembly to the surface and provides data telemetry and allows control of the valve assembly with a remote electronic signal. In one embodiment, multiple valve assemblies are provided at spaced intervals along the tubing string, interconnected by a single cable for transmitting power and/or data, allowing actuation and control of each valve assembly, and data telemetry from each position along the tubing string to a remote location.

In one embodiment, disclosed is a downhole valve that may be used for wellbore injection into and/or wellbore production from an oil and gas well. In one embodiment, the valve comprises an inlet port and an outlet port, a valve moveable between an open position and a closed position within the valve, and an electric motor coupled to the valve plug. In one embodiment, the valve is responsive to electrical signals provided by a remote location. The valve is configured to be coupled with a tubing sub, such as within a channel or trough of the sub. The valve may be configured to be fluidly connected to an interior portion of a tubing string.

In one embodiment, the valve plug is moveable between the closed position and the open position based on actuation of the electric motor. The valve may be configured to control both inflow and outflow from the valve. The valve plug may control the fluid flow between the inlet port and the outlet port. In one embodiment, the closed position substantially blocks fluid flow between the inlet port and the outlet port. In one embodiment, the inlet port is in fluid communication with an inner portion of a tubing string and the outlet port is in fluid communication with an exterior portion of the tubing string. In one embodiment, the valve plug seals against the inlet port and the outlet port. In other embodiments, the valve prevents fluid flow through the valve by sealing only against one of the inlet port or the outlet port. In one embodiment, the inlet port is a lateral opening and the outlet port is an axial opening. In other embodiments, the outlet port may be a lateral opening. In one embodiment, the inlet port may function as the outlet port and the outlet port may function as the inlet port depending on the intended flow of fluid through the valve.

In one embodiment, the valve comprises a valve chamber, wherein the valve chamber fluidly connects the inlet port to the outlet port. In one embodiment, the valve comprises a valve seat, wherein the valve plug seals against the valve seat in the closed position. In one embodiment, the valve plug comprises an elongated dart, wherein the elongated dart comprises a head portion and a shaft portion. In one embodiment, the valve comprises a motor controller coupled to the electric motor. In one embodiment, there is at least one sensor within the valve. The sensor(s) may measure fluid flow, valve position, pressure, temperature, and/or water cut. In one embodiment, the valve is coupled to an electrical cable, wherein the electrical cable is electrically coupled to the remote location. In one embodiment, the valve comprises one or more drive shafts that couple the electric motor to the valve plug. In some embodiments, rotation of the one or more drive shafts rotates the valve plug and/or linearly moves the valve plug.

In another embodiment, disclosed is a downhole flow control apparatus that comprises a lateral port, an axial port, a housing including an inner cavity, wherein the inner cavity is in fluid communication with the lateral port and the axial port, a flow control member at least partially disposed in the inner cavity that is moveable within the inner cavity between a closed position and an open position, and an actuator that moves the flow control member in response to a remote electrical signal. In one embodiment, the actuator is a reversible DC motor. In one embodiment, the flow control member is an elongated dart. In one embodiment, the flow control apparatus is coupled to an electrical cable, wherein the remote electrical signal is provided to the flow control apparatus via the electrical cable. In one embodiment, the flow control apparatus is configured to be coupled with a tubing sub.

In another embodiment, disclosed is a downhole valve that comprises a valve section, a power section, and an electronics section. The valve section may comprise a valve plug (such as an elongated dart), a first port (such as a lateral port), and a second port (such as an axial port). The power section may be operatively coupled to the valve section (such as the valve plug), and the power section may comprise a motor and in some embodiments one or more drive trains. The electronics section may be electrically coupled to the power section, and may comprise one or more sensors, a control board, and a motor controller. In one embodiment, the motor is configured to actuate the valve plug in response to an electric signal provided by a remote location.

In another embodiment, disclosed is a downhole valve system that comprises a tubing sub and a valve assembly coupled to the tubing sub. In one embodiment, the tubing sub has a valve opening in an exterior wall of the tubing sub and the valve assembly has a first port and a second port. In one embodiment, the first port is in fluid communication with the valve opening. In one embodiment, the valve assembly is responsive to a remote electronic signal. The valve assembly may be configured to move between an open position and a closed position based on the remote electronic signal. In one embodiment, the valve assembly comprises an electrical cable coupled to the valve assembly, wherein the remote electronic signal is provided on the electrical cable.

In one embodiment, the tubing sub has a plurality of ends, wherein each of the plurality of ends is coupled to a length of jointed tubing. The tubing sub may comprise a trough that is configured to receive the valve assembly. A plurality of brackets may securely attach the valve assembly to the tubing sub, such as by securely retaining the valve assembly within the trough.

In one embodiment, the first port is in fluid communication with the valve opening, while the second port is in fluid communication with an exterior portion to the tubing sub. For example, the first port may be in fluid communication with an inner section of a tubing string and the second port may be in fluid communication to an annulus of the tubing string. In one embodiment, the first port is located on a lateral portion of the valve assembly and the second port is located on an axial portion of the valve assembly. In one embodiment, the valve assembly comprises a first mode and a second mode, wherein the first mode comprises an injection mode and the second mode comprises a production mode. In one embodiment, the first port functions an inlet port and the second port functions an outlet port while the valve assembly is in the production mode, wherein the first port functions as an outlet port and the second port functions as an inlet port while the valve assembly is in the injection mode.

In another embodiment is disclosed a downhole valve system that comprises a plurality valve assemblies. In one embodiment, a plurality of downhole valve assemblies may be coupled to a downhole tubular at a plurality of different locations, wherein each of the plurality of downhole valves assemblies are coupled together by an electrical cable, and wherein each of the plurality of downhole valve assemblies is individually controlled from a remote location by an electronic signal provided by the electrical cable. In one embodiment, the downhole tubular comprises jointed tubing. In other embodiments, the downhole tubular comprises production lining or slotted lining. In one embodiment, each of the plurality of downhole valve assemblies is coupled to the downhole tubular by a tubing sub. In one embodiment, each of the plurality of downhole valve assemblies is configured to control fluid flow between an annulus of the downhole tubular and an inner section of the downhole tubular. In one embodiment, the remote location comprises a surface of the borehole.

Also disclosed a method for operating a downhole valve, wherein the method may comprise providing a remote electrical signal to a valve assembly, wherein the valve assembly is coupled to a tubing string, selectively actuating the valve assembly based on the remote electrical signal, and controlling fluid flow through the valve assembly between an inner portion of the tubing string and an annulus of the tubing string based on the actuation step. The method may further comprise coupling a tubing sub to a tubing string and coupling the valve assembly to the tubing sub.

In one embodiment, the controlling step comprises controlling fluid flow between an inner portion of the tubing string and an annulus of the tubing string. In one embodiment, the controlling step comprises automatically adjusting a valve opening within the valve assembly based on one or more measured parameters. In one embodiment, the method comprises providing positive feedback to a remote location of one or more valve assembly parameters. In one embodiment, the method comprises monitoring one or more downhole parameters and controlling the valve assembly based on the monitored downhole parameters. For example, the downhole parameters may include temperature, pressure, water cut, or valve opening. In one embodiment, the actuating step comprises opening the valve assembly to a desired setpoint. For example, the setpoint may be a particular valve opening, or a desired flow rate, or a desired temperature or pressure. The method may further include injecting fluid into the tubing string through the valve assembly. The method may further include producing fluid from the tubing string through the valve assembly. In one embodiment, the disclosed method and valve assembly has a first mode that is an injection mode and a second mode that is a production mode.

In one embodiment, disclosed is a method for operating a plurality of downhole valves. In one embodiment, the method may comprise providing a plurality of downhole valves coupled to a downhole tubular at a plurality of different locations, wherein each of the plurality of downhole valves assemblies is coupled together by an electrical cable, selectively actuating at least one of the plurality of downhole valves based on a remote electrical signal provided on the electrical cable, and controlling fluid flow through the at least one downhole valve between an inner portion of the tubular and an annulus portion of the tubular based on the actuation step. In one embodiment, the method may further comprise closing at least one of the plurality of downhole valves while at least some of the plurality of downhole valves are substantially open. In one embodiment, the method may further comprise opening at least one of the plurality of downhole valves while at least some of the plurality of downhole valves are substantially closed. In one embodiment, the method may further comprise individually controlling each of the plurality of downhole valves from a remote location based on communications provided by the electrical cable. In some embodiments, the method may comprise opening some of the valves while closing some of the valves. In other embodiments, the method may comprise injecting fluid into some of the valves while producing fluid from some of the valves.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DETAILED DESCRIPTION

Figure 1A:
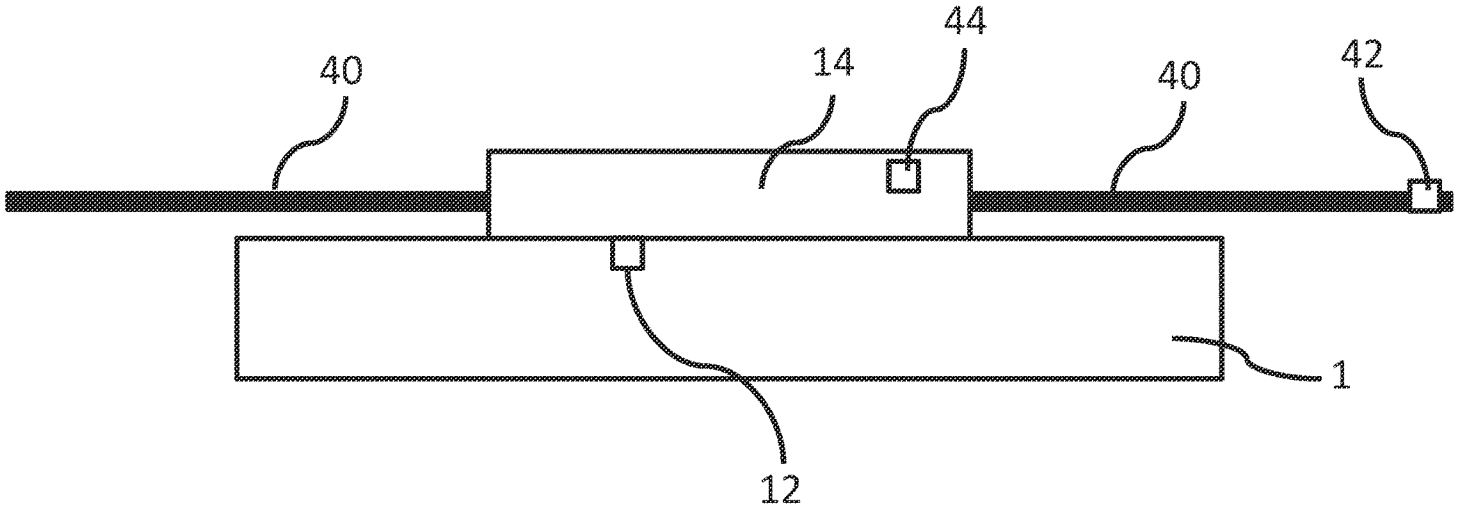
FIG. 1A illustrates a schematic view of a downhole valve assembly coupled to a tubing string according to one embodiment of the present disclosure.

Various features and advantageous details are explained more fully with reference to the nonlimiting embodiments that are illustrated in the accompanying drawings and detailed in the following description. Descriptions of well-known starting materials, processing techniques, components, and equipment are omitted so as not to unnecessarily obscure the invention in detail. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure. The following detailed description does not limit the invention.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures, or characteristics may be combined in any suitable manner in one or more embodiments.

As used herein, longitudinal or "axial" means aligned with the long axis of tubular elements associated with the disclosure, and transverse means a direction that is substantially perpendicular to the longitudinal direction. As used herein, uphole and downhole are used to describe relative longitudinal positions of parts in the well bore. One of skill in the art will recognize that wellbores may not be strictly vertical or horizontal, and may be slanted or curved in various configurations. Therefore, the longitudinal direction may or may not be vertical (i.e., perpendicular to the plane of the horizon), and the transverse direction may or may not be horizontal (i.e., parallel to the plane of the horizon). Further, an uphole part may or may not be disposed above a downhole part. As used herein, tubing string may refer to any tubular structure in a wellbore that may be used to convey fluid in a wellbore. Non-limiting examples of tubing string include rigid pipe segments, and coiled tubing.

In one embodiment, the valve assembly of the present disclosure is configured to attach to or be part of a tubing string used to convey fluids in a wellbore. In one embodiment, the tubing string comprises conventional jointed tubing. In one embodiment, the tubing string may be located in a horizontal well, a vertical well, and/or one or more lateral wells. In one embodiment, the disclosed valve assembly may be for water and/or polymer applications, and allows for increased production, water, and/or gas injection flow, control, and/or monitoring in downhole conditions. As may be appreciated, the downhole valve can be used in a wide variety of downhole operations and conditions. The disclosed system provides accurate, real-time data of downhole conditions on the inside and outside of the tubing string and allows for the monitoring and change of valve positions for a plurality of downhole valves via electronic signals.

In one embodiment, the valve assembly comprises a valve section, a power section, and an electronics section. In one embodiment, the disclosed valve has the ability to control both inflow and outflow from the tubing string (i.e., the valve is not limited to being directional with fluid flow). The various sections of the valve assembly may be made up with a number of elements and/or components that are coupled together to form the individual sections. In one embodiment, the sections are coupled together to form the overall valve assembly. In one embodiment, the valve assembly comprises a motor coupled to a drive train that is coupled to a flow control member or plug. In one embodiment, the valve assembly comprises a plurality of integrated, real-time sensors, such as pressure and temperature sensors, as well as water cut and fluid flow rate sensors, that provide real time data on conditions inside and outside the tubing string.

In one embodiment, the disclosed valve assembly is not mechanically actuated and is rather electronically controlled from a remote location (such as on the surface) by one or more electronic signals. Electronic control provides full control of the valve orifice from fully open to fully closed, and allows positive feedback and known orientation of the valve assembly. Any percentage (from 0 to 100 percent, such as 26 percent open) can be set and feedback provided on the valve position. In other words, the present disclosure provides continuous measurements and infinite individual control via real-time data for a plurality of downhole valves. Control may be performed remotely at the surface without entering the well with any additional tools; in other words, the disclosed valves are configured to be electronically activated, monitored, and controlled from the surface.

In one embodiment, a cable may be coupled to the valve assembly and may travel outside or inside of the tubing string between the valve assembly and a surface location. In some embodiments, a plurality of valves as disclosed herein may be positioned along the tubular string and be coupled by a single cable for electronic control. The plurality of valves may be positioned at regular or variable intervals along the tubular string. In some embodiments, the disclosed valves and/or the cable between the valve(s) may include sensors for additional control and/or feedback related to the valves. The cable may be traditional tubing encapsulated cable (TEC) and/or other downhole instrumentation cable. The cable and coupled valves allows control of the plurality of valves from a remote location.

In one embodiment, the disclosed valve is able to be coupled to a wide range of downhole equipment or tools, such as tubing joints. In one embodiment, the valve is well suited for small diameter tubing and annular spaces. In one embodiment, the disclosed valve can be used in a small, compact configuration, allowing its use with, for example, a 2⅜" diameter tubing in 4" casing, or even smaller. The valve can be scaled up for additional pipe sizes, such as up to 7" ID. However, in general, the disclosed valve may be used with any size tubing and casing.

FIG. 1A illustrates a schematic of one embodiment of the present disclosure. Valve assembly 14 may be coupled to an exterior portion of tubing string 1. In one embodiment, the tubing string comprises conventional jointed tubing and is used to convey fluids in a wellbore. As is known in the art, tubing string 1 may have a plurality of tubing subs 10 (see FIG. 3A) that are positioned in line with the tubing string. The sub may have threaded ends which match the threaded ends of the jointed tubing. In one embodiment, the tubing sub may be in effect a downhole mandrel on which other components are arranged or assembled (such as the disclosed valve). As is known in the art, a mandrel is a specialized tubular component such as a bar, tube, shaft, or spindle around which other components are arranged or assembled. A tubing sub, as disclosed herein, may be used interchangeably with a mandrel. In one embodiment, a portion of the tubing string, such as the tubing sub, may have valve opening/orifice 12 through a wall of the pipe, which allows fluids to enter or exit the tubing string. Valve opening 12 is a controlled inlet and outlet orifice to the tubing string. In one embodiment, valve assembly 14 may be positioned adjacent to valve opening 12 such that a portion of the valve assembly with a lateral opening is in fluid connection with valve opening 12. As shown in detail in subsequent figures, valve assembly 14 comprises an additional passage that allows fluids to enter or exit the valve assembly as desired from an exterior portion of the tubing string (such as an annulus of a well), and consequently, allows fluid to enter or exit the tubing string through the fluid connection between valve 14 and valve opening 12.

In one embodiment, valve assembly 14 may be electronically coupled to other downhole equipment and the surface via electric cable 40. Electric cable 40 may be any downhole instrumentation cable, such as tubing encapsulated cable (TEC), and may transmit data and/or power between various downhole devices, such as a plurality of downhole valve assemblies and/or sensors. In one embodiment, cable 40 is a 4 conductor ¼" TE cable that allows data communication between downhole equipment (tools, sensors, etc.) and the surface. Cable 40 may be directly or indirectly coupled to valve assembly 14, such as by induction means or wet or dry electrical connectors. In one embodiment, valve assembly may also comprise one or more sensors 44 to monitor various conditions downhole. Sensor 44 may be located within or adjacent to the valve assembly. In one embodiment, electrical cable 40 is directly coupled to a control circuit within the valve assembly, which is then directly coupled to one or more sensors 44. In one embodiment, sensor 44 may comprise a wide variety of sensors as is known in the art, such as temperature, pressure, acoustic, and flow rate. In another embodiment, cable 40 may also comprise sensors 42 (exterior to the valve assembly) to monitor various conditions downhole. Valuable data may be collected and read from the surface, in real-time or near real-time, by the telemetry sensors and/or cable 40.

As described herein, one embodiment of the disclosed valve assembly is coupled to a tubing sub (or mandrel) that is substantially in-line with a tubing string. The tubing string may be located in a horizontal, vertical, or lateral well. Further, the disclosed valve assembly can be attached to a tubing string, production liner, slotted liner, coiled tubing, and even surface lines. In other words, the disclosed valve assembly may be coupled to a wide variety of tubulars, fluid passageways, or fluid containing devices to control fluid flow in and out of the relevant device. Still further, while one embodiment of the disclosed valve assembly is located downhole, the valve assembly disclosed herein is not limited to downhole applications and in some embodiments may be used in surface applications.

Figure 1B:
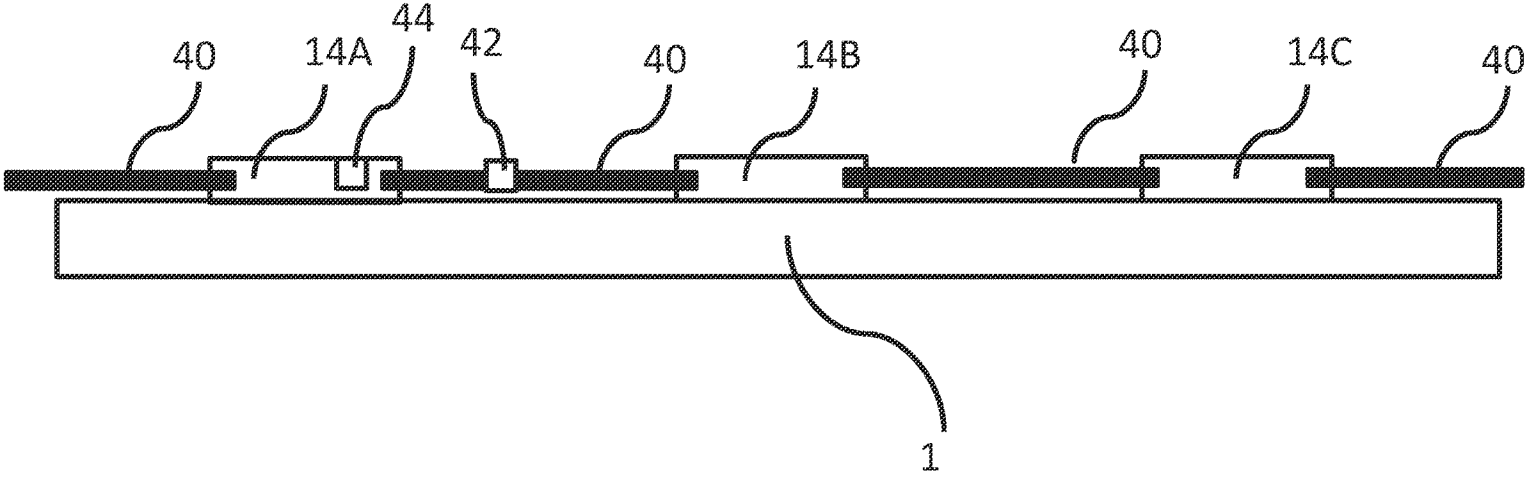
FIG. 1B illustrates a schematic view of a plurality of downhole valve assemblies coupled to a tubing string according to one embodiment of the present disclosure.

FIG. 1B illustrates a schematic of another embodiment of the present disclosure. In one embodiment, a plurality of downhole valves 14 (such as 14A, 14B, and 14C) may be coupled to tubing string 1. A single electrical cable 40 may be coupled to each valve and allow for remote electronic control of each of the plurality of valves at a remote location, such as the well surface. In one embodiment, the tubing string may be located in a horizontal well, a vertical well, and/or one or more lateral wells, and the plurality of valves (and sensors) allows for better monitoring and control of each section of the well. Depending on the connection to each of the valve assemblies, cable 40 may have a plurality of separate cable sections, but still may be considered as a single electrical cable. As in FIG. 1A, cable 40 may be coupled to a plurality of sensors 42, 44 positioned at different points along the cable to monitor downhole conditions along an exterior portion of the tubing string, such as within (see, e.g., sensor 44) and/or adjacent (see, e.g., sensor 42) to each of the valve assemblies. The use of downhole sensors connected to the cable allows for more accurate monitoring of downhole conditions, and in one embodiment, control of a particular valve assembly (and the results thereof) is monitored by the adjacent sensors. For example, valve assembly 14A may be directed to open to a certain "open" position, and the sensor(s) within valve 14A may be monitored to determine the effect of opening valve 14A on one or more fluid parameters, such as flow rate. Depending on the desired downhole parameter, valve 14A may be adjusted based on the results from sensors 44. Similarly, each valve may be separately controlled and monitored. In one embodiment, at least thirty (30) valves may be linked together to a single electrical cable for distances up to 5000 meters. Of course, one of skill in the art will realize that additional valve and additional distances may be achieved based on the design of the well, cable, and downhole assemblies. The valves may be separated by fixed, regular, or variable intervals.

Figure 2A:
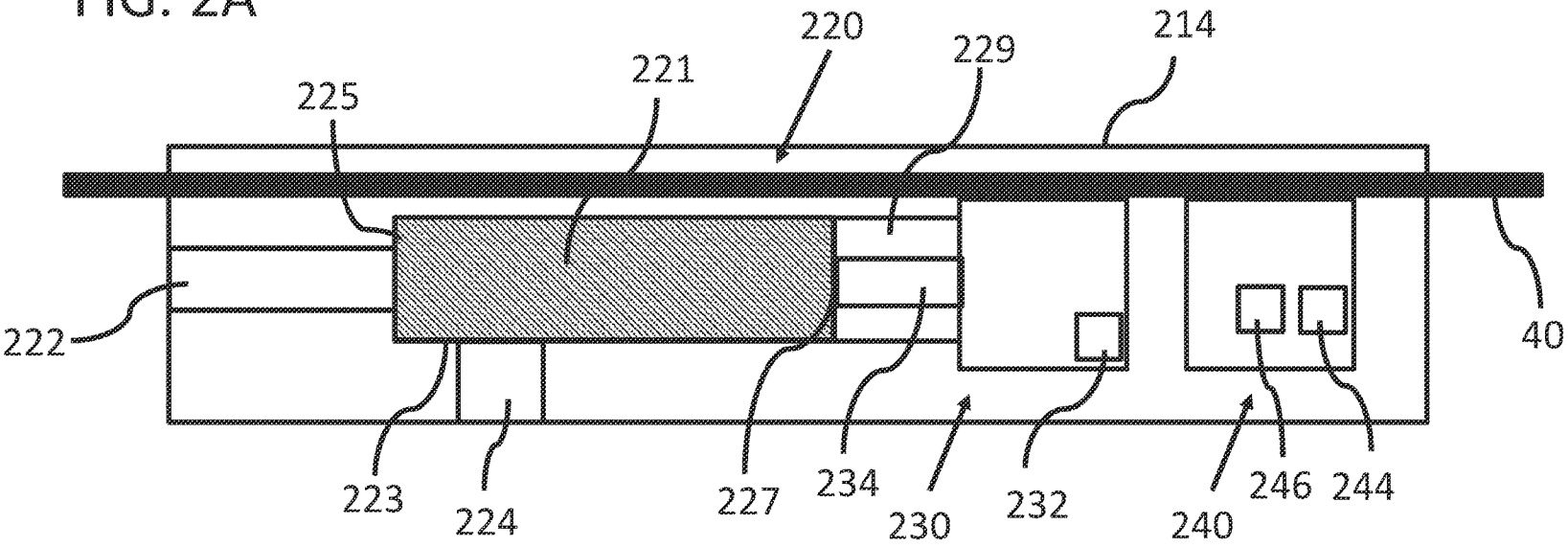
FIG. 2A illustrates a schematic view of a downhole valve assembly in a substantially closed position according to one embodiment of the present disclosure.
Figure 2B:
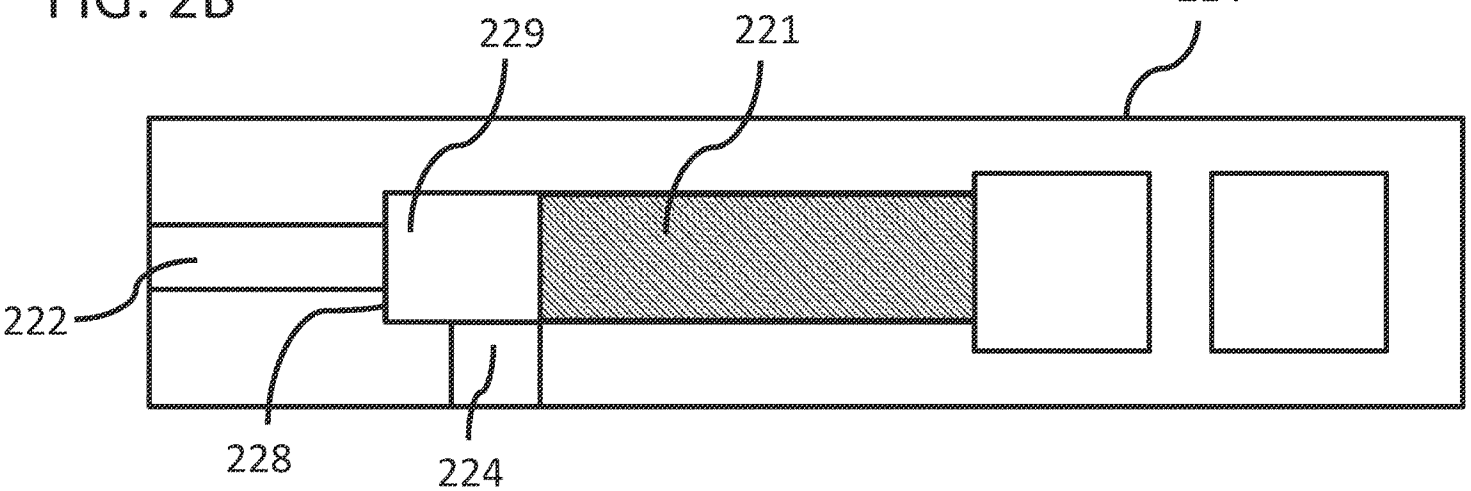
FIG. 2B illustrates a schematic view of the downhole valve assembly in a substantially open position according to one embodiment of the present disclosure.

FIGS. 2A and 2B illustrate a schematic view of one embodiment of a valve assembly of the present disclosure, in a substantially closed and open position, respectively. The valve assembly and components in FIGS. 2A and 2B are the same, but for simplicity many of the elements in FIG. 2B are not numbered. For the purposes of this disclosure, an open position may be considered as the position of the valve plug within the valve assembly when the plug (or dart) is retracted beyond orifice 224 to allow fluid flow between a first port and a second port of the valve assembly, while a closed position within the valve assembly may be considered as the position when the valve plug (or dart) contacts a sealing face or valve seat within the valve assembly to prevent fluid flow between the first and second ports of the valve assembly. Of course, the valve assembly may be actuated to any number of incremental positions between the substantially open and substantially closed position as desired and as described herein.

As illustrated in FIGS. 1A and 1B, valve assembly 210 may be coupled to a tubing sub and/or tubing string and be used to control fluid flow into or out of the tubing string at isolated locations along the tubing string. Valve assembly may be coupled to electrical cable 40, and as shown in FIG. 1B, a plurality of valves may be located on the tubing string and be electrically coupled together and/or with a remote location (e.g., the surface) via TEC cable 40.

As illustrated in FIG. 2A, in one embodiment, valve 214 comprises valve section 220, power section 230, and electronics section 240. In one embodiment, electronics section 240 is coupled to power section 230 which is coupled to valve section 220. In one embodiment, the various sections or systems may each comprise a number of elements. In one embodiment, each section and/or element of the valve assembly may be threaded and/or coupled together to form an inner cavity in which some of the valve assembly components fit within.

In one embodiment, valve section 220 comprises lateral port 224 that opens into valve chamber 229 and axial port 222 that opens into valve chamber 229. In one embodiment, port 222 is considered the main valve passage and/or exterior opening because it is in fluid communication with the exterior portion of the tubing string, such as fluids existing in the annulus of the borehole. In one embodiment, lateral port 224 may align with valve opening 12 (see FIG. 1A) when the valve assembly is properly positioned adjacent to the tubing string. In one embodiment, opening 222 is located on an axial side of the valve assembly, opens into valve chamber 229, and provides fluid communication between an exterior portion of the tubing string (such as the annulus of the borehole) and the valve assembly. Depending on the intended fluid flow direction, lateral port 224 may act as the inlet port while axial port 222 may act as the outlet port or, conversely, lateral port 224 may act as the outlet port while axial port 222 may act as the inlet port. In some embodiments, port 222 may be located on a lateral side of the valve assembly instead of an axial end, such as the opposing lateral side of chamber 229. As is known in the art, valve chamber 229 may be slightly larger than valve plug 221, and one or more seals may be arranged on the plug to seal against unwanted fluid flow. In one embodiment, valve plug 221 moves within inner chamber 229 in a longitudinal direction of the valve assembly.

In one embodiment, valve section 220 comprises valve plug 221 that is coupled to power section 230 via drivetrain 234. In one embodiment, valve plug 221 may have any number of configurations, such as a dart, flat face, stepped body, or knife. In one embodiment, plug 221 is an elongated dart with head 225, tail 227, and side 223. Plug 221 may be positioned within cylindrical valve chamber 229. In one embodiment, plug 221 is configured to seal against lateral port 224 and/or axial port 222. For example, a lower end of valve chamber 229 may have a valve seat 228 (see FIG. 2B) adjacent to opening 222 that is configured to receive a portion of head 225 of the valve plug. Thus, the valve plug is positioned within the valve assembly such that its head 225 is disposed within valve chamber 229 to seal against opening 222, port 224, and valve seat 228.

In one embodiment, valve plug 221 is moveable between a substantially closed position (see, e.g., FIG. 2A) and a substantially open position (see, e.g., FIG. 2B) to open and/or close (and anywhere there between) valve assembly 214. In one embodiment, plug 221 may be actuated to close valve opening 12 (see FIG. 1A) by covering lateral port 224 and sealing against valve seat 228. Valve opening 12 can be incrementally opened by moving plug 221 off of valve seat 228 and at least partially uncovering lateral port 224 (which fluidly connects opening 222 to lateral port 224). Valve opening 12 can be moved to a substantially open position by fully moving the plug off of valve seat 228 and substantially uncovering lateral port 224. In one embodiment, the disclosed valve plug is configured to move in very small increments to give fine control over the valve assembly and fluid flow through the valve. In one embodiment, valve assembly 214 allows fine control over valve opening 12 (as well as valve assembly 214) from any position from fully open to fully closed to accommodate any injection or production scenario. For example, if desired, the valve opening may be opened to approximately 26% if that is the particular opening preferred for the desired fluid flow rate. The amount of opening may be measured by a number of different attributes, such as flow rate, percentage opening of the lateral port, rotations/turns of the valve plug, or linear distance of the valve plug.

Valve plug 221 may be moved by rotation and/or linear movement of the valve plug. In one embodiment, valve plug 221 is coupled to drive shaft 234 which is coupled to motor 232. In one embodiment, the valve plug may be moved axially based on linear or rotational movement of the motor and/or drive shaft. In one embodiment, the valve plug may comprise a worm gear, ball screw, direct drive torque motor, or linear DC servo motor, each which is available to those of skill in the art. In one embodiment, drive shaft 234 extends through power section 230 and connects to motor 232. Thus, motor 232 is operatively coupled to valve plug 221 via drive shaft 234. In one embodiment, motor 232 rotates drive shaft 234 which subsequently rotates valve plug 221. In one embodiment, motor 232 is a reversible DC motor as is known in the art Electronics section 240 may comprise motor controller 246 and various sensors 244, such as telemetry, valve position, and electric sensors. In one embodiment, motor controller 246 is a conventional controller known to those of skill in the art and it is operatively coupled to motor 232. Controller 246 may be electrically controlled from the surface via cable 40. Controller 246 allows fine control over the motor.

Figure 2C:
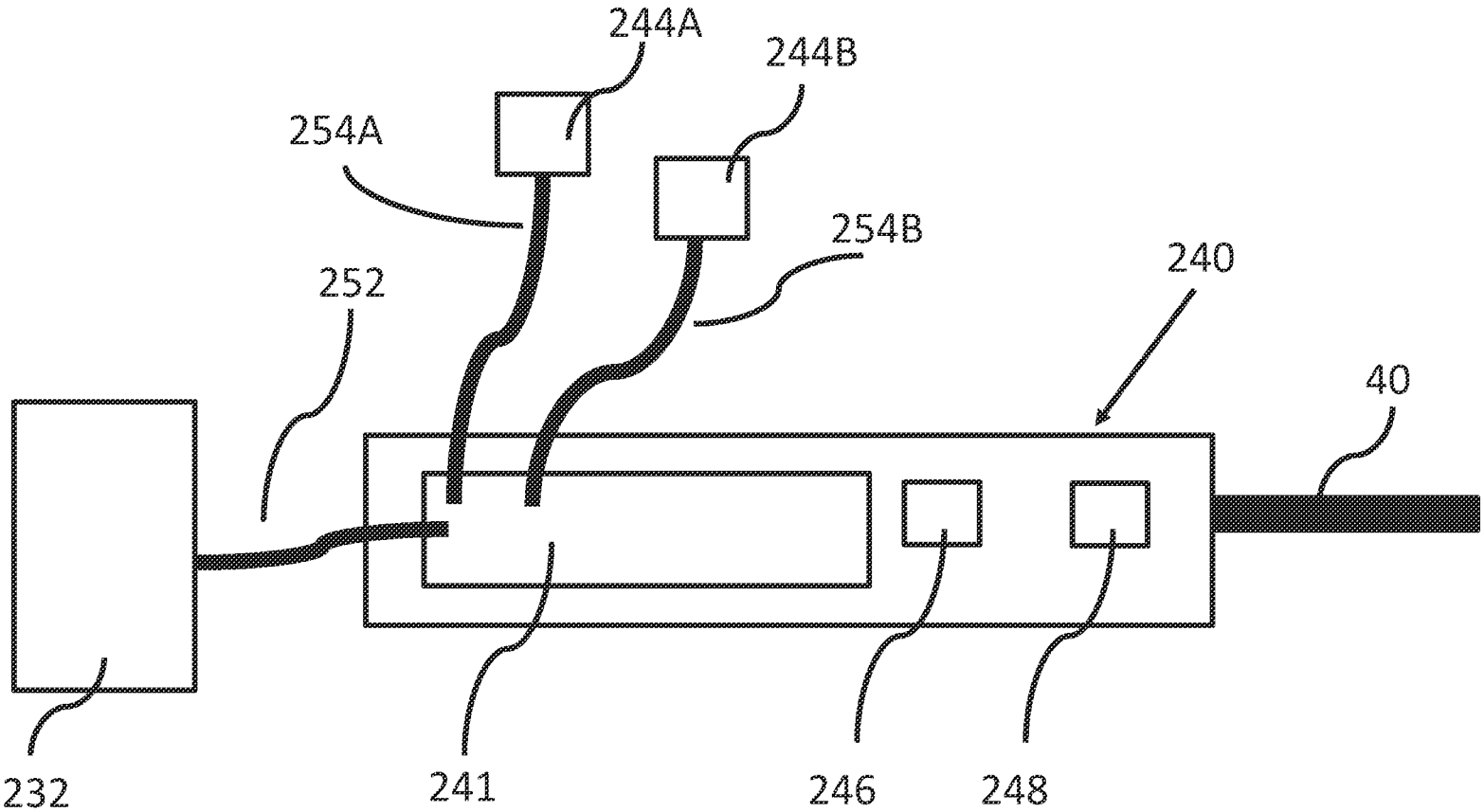
FIG. 2C illustrates a schematic view of an electronics section of a downhole valve assembly according to one embodiment of the present disclosure.

FIG. 2C illustrates a schematic view of one embodiment of electronics section 240 of the valve assembly of the present disclosure. In one embodiment, electronics section 240 is substantially similar to the electronics disclosed in FIGS. 2A and 2B. In one embodiment, electronics section 240 comprises circuit board 241, motor controller 246, and may have integrated sensors or sensor circuitry 248. TEC cable 40 may be coupled to electronics section 240, such as by being directly coupled to control board 241, and additional valve assemblies and/or a remote surface location. Thus, operators at a remote location may communicate with and/or control the downhole valve assembly via communication over cable 40 and electronics section 240. For example, an operator may have full control of valve opening 12 and/or valve assembly 214 from the surface (or another remote location, such as a portable handheld device or computer), without entering the well and without any additional tools. Electronics section 240 may also comprise one or more integrated sensors 244A, 244B, which may be any type of downhole sensor such as pressure, temperature, and/or water cut sensors. These sensors may be located within the valve assembly or external to the valve assembly. In one embodiment, the sensors are located within a chamber of the valve assembly, internal to the tubing string, and/or external to the tubing string. In one embodiment, the sensors may comprise position sensors that provide positive feedback and known orientation of the valve assembly and/or components within the valve assembly (e.g., the position of the valve plug). In one embodiment, control board 241 is coupled to motor 232 by wires 252, and sensors 244A and 244B are coupled to control board 241 via wires 254A and 254B, respectively. In one embodiment, wires 252 and 254 are contained within valve assembly 214 such that they are not exposed to any fluids or harsh environments.

As is known in the art, communication to downhole components over a long distance is problematic with any telemetry-based technology. In other words, signals from a power supply and/or remote location over a long length provide numerous issues, such as signal conditioning. Necessary software and user interface (UI) may be necessary, as is known in the art, to push power (TX) and receive data (RX) from a downhole valve to the surface at distances over 5000 km. The present disclosure allows real-time data communications and/or power to be transmitted to a plurality of downhole valves via a single electrical cable over distances over 5000 km and avoids numerous signal conditioning issues existing in the prior art. Using the appropriate user interfaces, the downhole valves and valve positions may be controlled from the surface or any other remote location. For example, any remote location can query the sensors for data and diagnostics for each valve. Further, the necessary control system and software allow for automation and control of the valves and valve positions based on real-time downhole conditions.

Figure 3A:
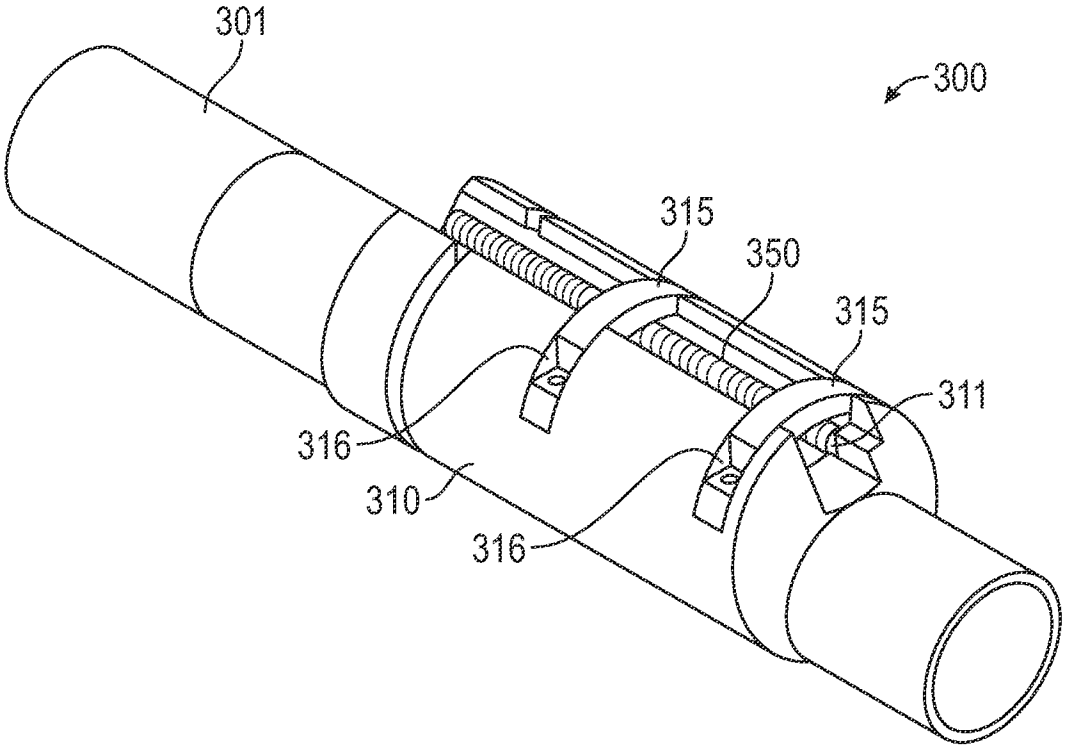
FIG. 3A illustrates a perspective view of a downhole valve assembly according to one embodiment of the present disclosure.
Figure 3B:
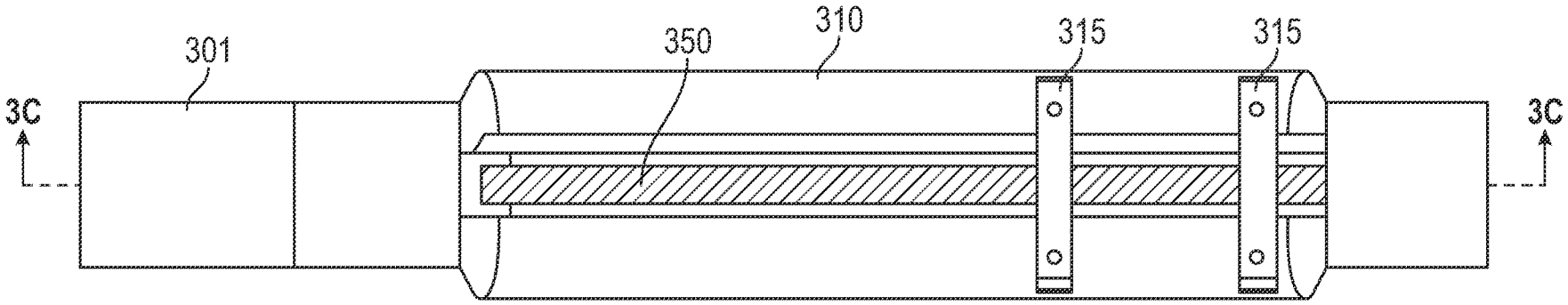
FIG. 3B illustrates a top-plan view of the embodiment from FIG. 3A.
Figure 3C:
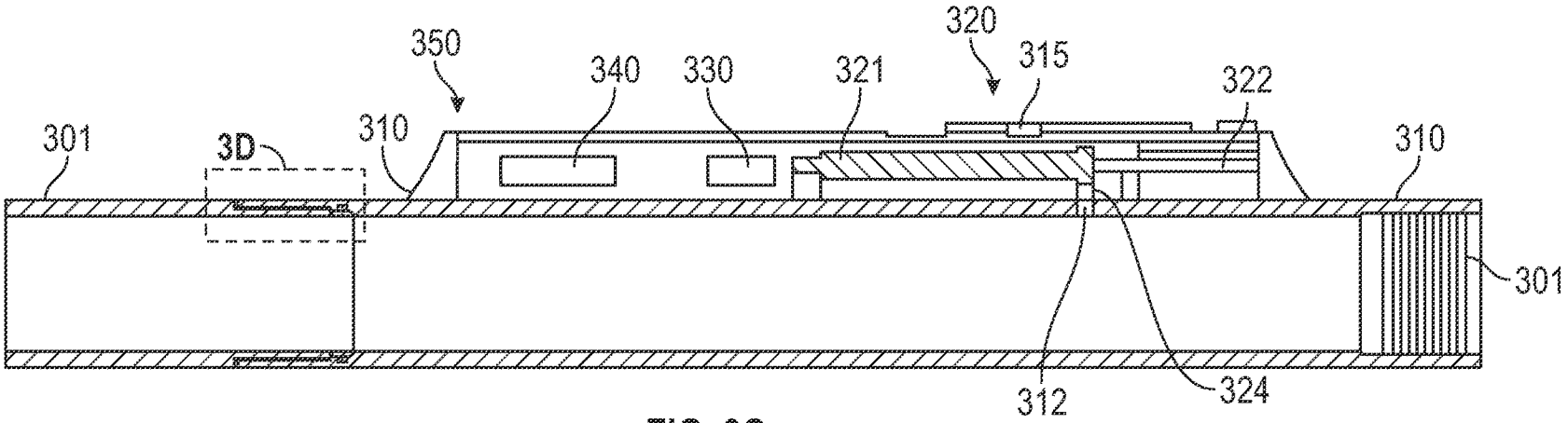
FIG. 3C illustrates a cross-sectional view along line 3C in FIG. 3B.
Figure 3D:
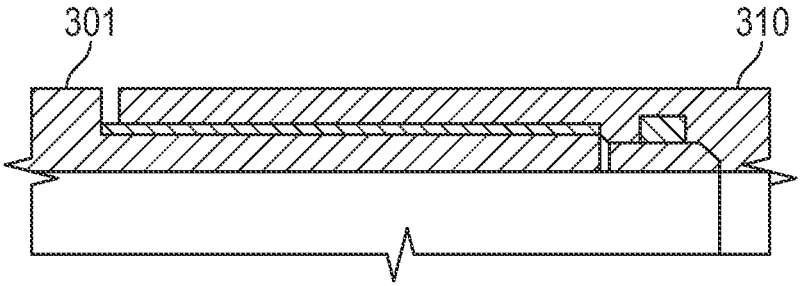
FIG. 3D illustrates a detailed view of portion 3D from FIG. 3C.
Figure 3E:
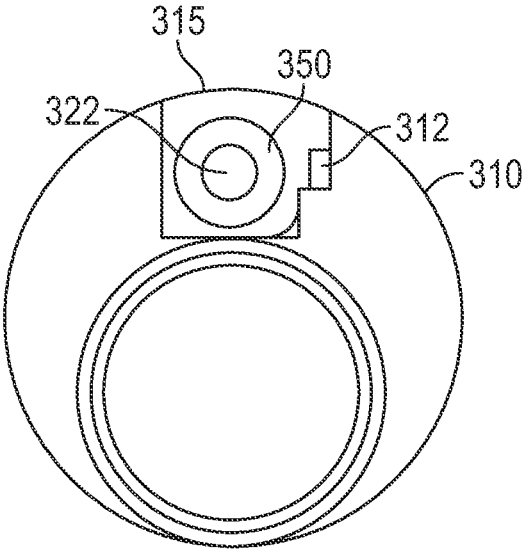
FIG. 3E illustrates an end-plan view of the embodiment from FIG. 3A.
Figure 3F:
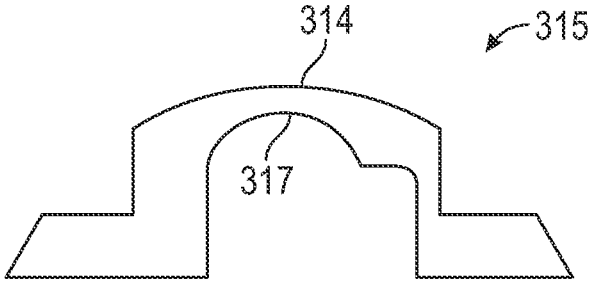
FIG. 3F illustrates an exemplary securing bracket for the valve assembly from FIG. 3A.

FIGS. 3A-3F illustrate various views of a valve assembly system according to one embodiment of the present disclosure. In particular, FIG. 3A illustrates a perspective view of one embodiment of the present disclosure showing a valve assembly coupled to a tubing sub, FIG. 3B illustrates a top-plan view of the embodiment from FIG. 3A, FIG. 3C illustrates a cross-sectional view along line 3C in FIG. 3B, FIG. 3D illustrates a detailed view of portion 3D from FIG. 3C, and FIG. 3E illustrates an end-plan view of the embodiment from FIG. 3A. FIG. 3F illustrates a securing bracket for the disclosed valve assembly according to one embodiment of the present disclosure.

In one embodiment, downhole valve system 300 comprises a valve assembly coupled to an offset tubing sub. For example, as illustrated in FIGS. 3A and 3B, valve assembly 350 may be coupled to offset tubing sub 310. In one embodiment, valve assembly 350 may be substantially similar to valve assemblies 14 and/or 214. As discussed above, tubing sub 310 may be configured to be placed in line with tubing string 301, and may be considered an offset sub or mandrel. As is known in the art, a tubing sub may have threaded ends (which may form a tubing coupling) which match the threads of the lengths of jointed tubing. For example, as shown in FIG. 3D, tubing sub 310 may have threaded ends which couple with threaded ends of tubing string 301. In other embodiments, the disclosed valve assembly may be coupled to other downhole tools or equipment, such as production liners, slotted liners, and coiled tubing. In one embodiment, the tubing sub may have a plurality of different diameters. For example, the threaded ends of the tubing sub may have a diameter that is substantially similar to a diameter of the tubing string, while a central portion of the tubing sub (where the valve is installed) may have a diameter that is larger than the diameter of the adjacent tubing string. In one embodiment, the diameter of the tubing string may be between 2-7 inches, such as approximately 2¾" tubing. In one embodiment, the tubing sub may have a length of approximately 16". In one embodiment, the tubing subs are coupled to the jointed tubing at the surface prior to insertion into the well; likewise, the valve assemblies are coupled to the tubing subs and a TEC cable is attached to each of the valve assemblies as the corresponding tubing section is inserted downhole. As illustrated in FIG. 1B, in one embodiment, a plurality of tubing subs and valve assemblies are provided along the length of the tubing string at different intervals, and a single TEC cable may be used to control all of the valve assemblies. In some embodiments, the tubing subs (and downhole valves) may be different sizes and/or diameters depending on their location on the tubing string.

Valve assembly 350 may be coupled to tubing sub 310 in any number of arrangements and by a variety of attachment mechanisms. In one embodiment, tubing sub 310 comprises trough or channel 311 that runs parallel to a long axis of the tubing sub. Trough 311 is configured to receive valve assembly 350 within the channel and to couple the valve assembly to the tubing sub and/or tubing string. Electrical cable 40 and various sensors may also be positioned within the channel and/or adjacent to the valve assembly when coupled to the tubing sub. On either side of the trough may be located recesses 316 which allows one or more attachment devices to securely couple the valve assembly to the tubing sub and within the channel. As illustrated in FIG. 3F, in one embodiment, a plurality of securing brackets or clamps 315 attach the valve assembly to the tubing sub. In one embodiment, two brackets 315 (see FIG. 3B) are used to attach the valve assembly to the tubing sub. A portion of each securing bracket 315 may be received into recesses 316 on either side of channel 311. As illustrated in FIG. 3F, the securing bracket may have an exterior portion 314 that is curved and an interior portion 317 that is configured to receive the valve assembly and any cable coupled to the valve assembly. In one embodiment, a small gap (such as gap 312 in FIG. 3E) is located between valve assembly 350 and tubing sub 310, which allows cable to run alongside the valve assembly and be secured by the securing bracket. Of course, the disclosed valve assembly may be securely attached to the tubing string and/or tubing sub by a wide variety of attachment mechanisms besides securing brackets 315. For example, openings and/or locks may be disposed on an inside surface of the channel that couple with corresponding surfaces of the valve assembly. In other embodiments, clamps, pins, latches, or welds may be used to securely couple the valve assembly to the tubing sub.

The disclosed valve is well suited for small to large diameter tubing and annular spaces. In one embodiment, the unique configuration of the tubing sub, valve assembly, and coupling means between the tubing sub and valve assembly allow use of the valve assembly in small spaces, such as a 2⅜" diameter tubing in 4" casing (or even smaller). This compact configuration is substantially better than conventional valve designs. As one example, the disclosed valve assembly configuration does not affect the internals of the tubing string. For example, as compared to conventional valve technologies, the disclosed valve does not affect the internal diameter of the tubing, and thus may be used for smaller diameter pipe than traditionally possible. Of course, the valve can be scaled up for additional pipe sizes, such as up to 7" ID. However, in general, the disclosed valve may be used with any size tubing and casing.

As illustrated in FIG. 3C, tubing sub 310 may have an opening located on a wall of the tubing sub, which allows fluid to enter or exit the interior of tubing string 301. In one embodiment, valve opening 312 is located on a wall pipe surface of tubing sub 310 within channel 311. In one embodiment, a corresponding opening on valve assembly 350 is positioned adjacent to valve opening 312 to allow fluid flow between valve assembly 350 and the inside of tubing string 301 and/or tubing sub 310 and between the annulus of the tubing string and the interior portion of the tubing string.

As illustrated in FIG. 3C, valve assembly 350 may comprise electronics section 340, power section 330, and valve section 320. In one embodiment, valve section 320 comprises main passage/opening 322, lateral port 324, and valve plug 321. In an assembled configuration of the valve assembly and the tubing sub, lateral port 324 is adjacent to valve opening 312. In one embodiment, valve plug 321 comprises an elongated dart, with a head portion and a shaft portion, that is coupled to power section 330. In one embodiment, such as for fluid production from tubing string 301, main passage 322 functions as an outlet and lateral port 324 functions as an inlet for the valve assembly; in other embodiments, such as for well injection, main passage 322 functions as an inlet and lateral port 324 functions as an outlet for the valve assembly. As described herein, each of the openings 322 and 324 may have different configurations and be located at different positions within valve assembly 350. Likewise, dart 321 may have different shapes and be in communication with openings 322 and 324 based upon the different valve assembly configurations.

As illustrated in FIG. 3E, an end plan view of the disclosed valve assembly from FIG. 3A illustrates the positioning of the tubing sub, valve assembly, and cable. Brackets 315 securely attach valve assembly 350 to tubing sub 310. In the embodiment disclosed in FIG. 3E, valve assembly 350 comprises main passage 322 (which is in fluid communication with an annulus of the tubing string) that functions as the valve inlet or outlet depending on the intended fluid operation of the valve. Between valve assembly 350 and tubing sub 310 is located small recess 312 that runs parallel to the long axis of the valve assembly and tubing sub. Recess 312 is configured to receive cable 40.

Figure 4A:
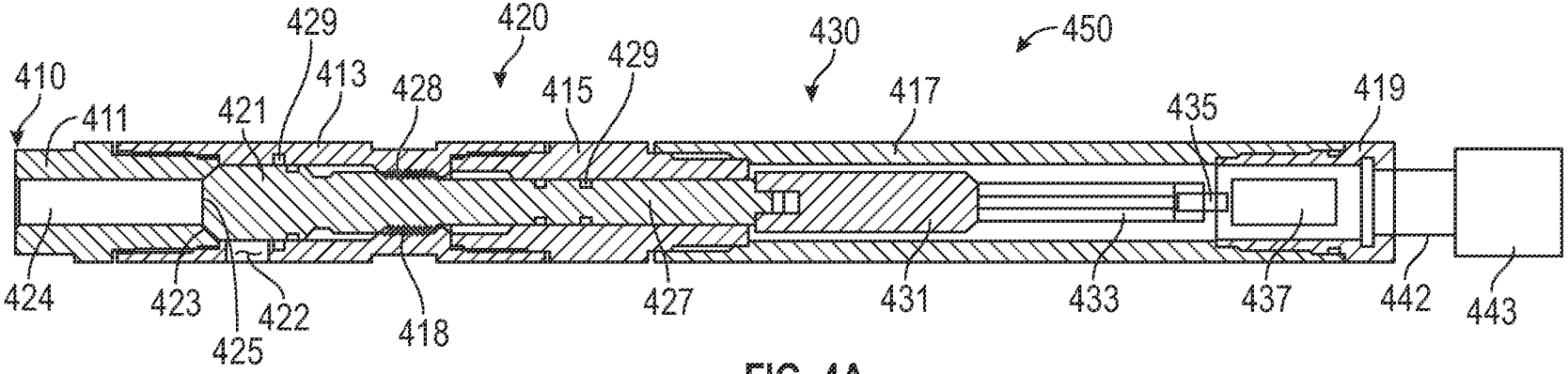
FIG. 4A illustrates a cross-sectional view of a valve assembly in a substantially closed position according to one embodiment of the present disclosure.

FIG. 4A illustrates a cross-sectional view of valve assembly 450 in a substantially closed position according to one embodiment of the present disclosure. In one embodiment, valve assembly 450 may be substantially similar to valve assembly 350. In one embodiment, valve assembly 450 may comprise valve section 420 and power section 430. In one embodiment, electronics section 443 (which may be internal or external to the inner housing cavity of the valve assembly) may be coupled to power section 430. In one embodiment, valve assembly 450 may comprise housing 410 that is formed of multiple housing elements threaded together to form a generally cylindrical cavity within the housing. For example, housing 411 may comprise main passage housing 411, valve body housing 413, dart shaft housing 415, drive housing 417, motor housing 419, and electronics housing 443. In some embodiments, the electronics section and the motor are located within the same chamber or housing. Main passage housing 411 comprises main passage 424 in an axial portion of the housing that enters inner cavity 426 (see FIG. 4B) and valve body housing 413 comprises lateral port 422 in a side portion of the housing. Valve body housing 413 and shaft housing 415 are threaded together to form valve chamber/cavity 426. Within valve chamber 426 is located valve plug 421.

Valve plug 421 may be an elongated dart, with dart head 425 and dart shaft 427. Dart 421 is positioned within the valve assembly such that its head portion 425 is disposed within valve chamber 426 and seals against lateral port 422, main passage 422, and/or valve seat 423. In one embodiment, the contact surfaces of valve seat 423 and head 425 must sealing mate to prevent fluid flow. One or more sealing systems 429 (e.g., O-rings) may be provided at various points along the dart, such as external portions of the dart and/or internal portions of the shaft housing 415, to ensure that fluid which passes through the valve is isolated substantially within valve chamber 426. Suitable seals may be fashioned from any suitable elastomer or polymer, as is well known in the art. In one embodiment, a washer element (not shown) may be provided around valve seat 423 to improve the valve seal at that position. The washer may comprise a nylon or Teflon™ material, and may be impregnated with a material (such as molybdenum) to improve mechanical strength.

In one embodiment, dart 421 may comprise a worm gear for actuation of the dart within the valve housing. For example, the worm gear may have a helical thread portion 428 on an external surface of dart shaft 427 (see also FIG. 6C), which mates with an internal thread portion 418 formed on the inside of valve housing 413. As may be appreciated by those skilled in the art, rotation of dart 421 causes it to move axially within the valve body as a result of the worm gear. Accordingly, dart 421 may be actuated to close a valve opening in a tubing sub (or other portion of the tubing string) by covering lateral port 422 and sealing against valve seat 423 with dart head 425. Conversely, moving dart 421 to open the valve can be performed by moving dart head 425 off the valve seat and at least partially uncovering lateral port 422, which opens up fluid communication between main passage 424 and lateral port 422. In other embodiments, the worm gear may be located on other portions of the valve plug. In still other embodiments, a worm gear may not be utilized. As one example, a ball screw may be used instead of a worm gear; a ball screw is a more efficient rotational power transfer but adds increased manufacturing complications. As another example, a linear DC motor (as opposed to a direct drive torque motor) actuates without rotation (e.g., it is a direct shaft shift); thus, a worm gear or other rotational to linear mechanism is not needed.

Power section 430 may comprise one or more drive shafts coupled to a motor or other actuator. For example, motor 437 may be located within an inner cavity of valve assembly 450, and a portion of the motor (such as motor bushing 435) may be coupled to second drive shaft 433 which is coupled to first drive shaft 431 which is coupled to valve plug 421. First drive shaft 431 may comprise an end with a female spline that is coupled to a portion of second drive shaft 433 with a male spline (see, e.g., FIGS. 6A-6B). In other embodiments, only a single drive shaft may be utilized. For example, use of a different type of motor (such as a linear DC motor) may not require the use of multiple drive shafts.

Thus, in one embodiment, dart shaft 427 connects (directly or indirectly) to motor 437. Motor 437 fits within valve assembly housing 410, such as within motor housing 419, and rotates the dart. In one embodiment, the motor is preferably a small reversible DC motor, but may be any other conventional actuator. While not specifically illustrated in FIG. 4A, the valve assembly may comprise additional electronic components within housing 415, such as a motor controller and circuit board. (See, e.g., FIGS. 2A, 2C.) In one embodiment, a conventional motor controller is operatively connected to the motor and may be controlled from the surface, as described herein, or any other remote location. Further, as illustrated in FIG. 4A, one or more telemetry sensors 443 may be located external to the valve body housing 410 and coupled to the electronics system within the valve assembly via wires 442. In some embodiments, the sensors may be positioned within the valve assembly itself or adjacent to one of the ports 422, 424.

Figure 4B:
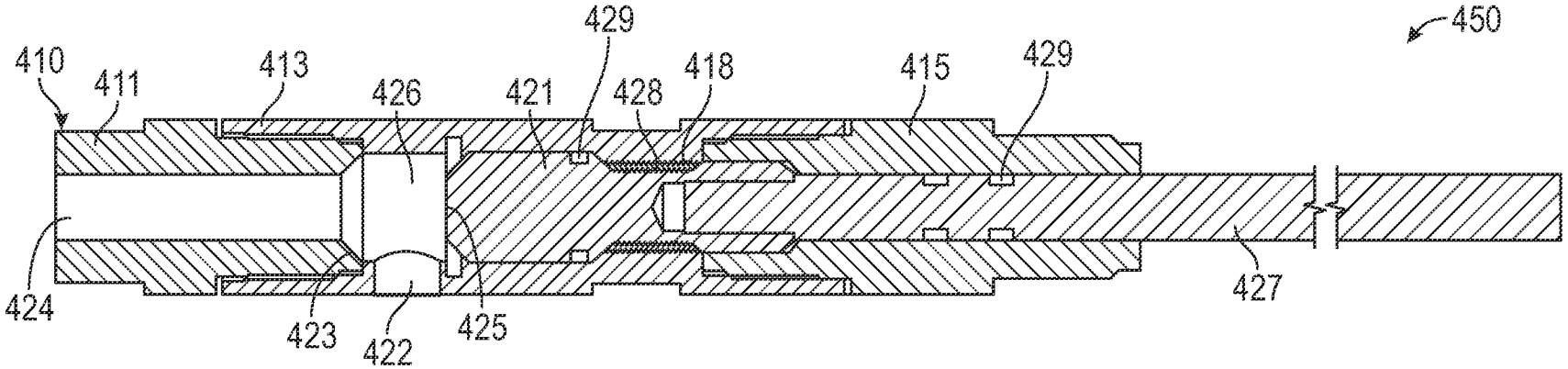
FIG. 4B illustrates a cross-sectional view of a valve assembly in a substantially open position according to one embodiment of the present disclosure.

FIG. 4B illustrates a cross-sectional view of the valve assembly from FIG. 4A in a substantially closed position according to one embodiment of the present disclosure. For simplicity purposes, portions of the valve assembly illustrate in FIG. 4A are not shown or numbered in FIG. 4B. FIG. 4B shows the valve assembly in a substantially open position because the valve plug (or dart) 421 does not cover lateral port 422 and allows fluid to fully flow between lateral port 422 and main passage 424. Of course, the valve plug may be partially opened and/or closed such that lateral port 422 is only partially blocked.

Figure 5:
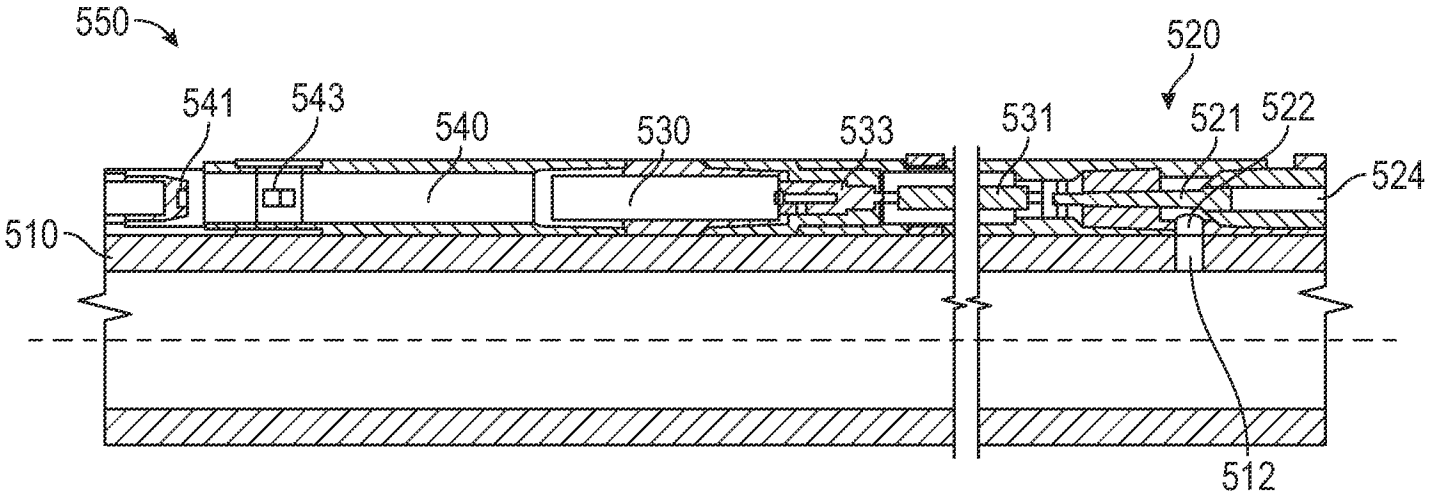
FIG. 5 illustrates a cross-sectional view of a valve assembly coupled to a tubing sub according to one embodiment of the present disclosure.

FIG. 5 illustrates a cross-sectional view of valve assembly 550 coupled to tubing sub 510, according to one embodiment of the present disclosure. Valve assembly 550 may be substantially similar to valve assemblies 350 and 450. In one embodiment, the tubing sub comprises valve opening 512 in a surface of a wall of the tubing sub, which may be positioned adjacent to a portion of the valve assembly for fluid communications between the valve assembly and valve opening 512. In one embodiment, valve assembly 550 comprises electronics chamber 540, motor 530, and valve section 520. Valve body housing may comprise lateral port 522 and axial port 524 in portions of the housing wall. In one embodiment, lateral port 522 is arranged substantially adjacent to valve opening 512 in tubing sub 510. In one embodiment, valve plug 521 blocks fluid flow from lateral port 522 to axial port 524, and thus blocks fluid flow through the valve assembly. As in other embodiments in the present disclosure, valve assembly 550 comprises one or more drive shafts that couple motor 530 to valve plug 521. In one embodiment, two drive shafts 531, 533 are utilized with corresponding male and female spindles. For example, first drive shaft 531 is coupled to valve plug 521, while second drive shaft 533 is coupled to motor 530 and first drive shaft 531. A plurality of sensors may be integrated within the valve assembly. In one embodiment, a first pressure and temperature sensor 541 is positioned to measure the annular tubing pressure (and temperature), and a second pressure and temperature sensor 543 is positioned to measure the internal tubing pressure (and temperature). Each of these sensors may be located internal or external to electronics section 540 and/or the valve assembly, and the measurements from the sensors is sent to the electronics section 540 for input to the associate control logic and/or to a remote location (e.g., the surface) for monitoring by an operator.

As described herein, the disclosed valve assembly utilizes a drive system that moves the valve plug between a plurality of valve positions. The drive may be any number of available drive train systems, including a ball screw, lead screw, worm gear, direct drive torque motor, linear motor, DC motor, and other actuators as is known in the art. In one embodiment, the motor is an electric motor as opposed to a pneumatic or hydraulic motor. In one embodiment, the motor may be linear or rotary, and may provide high precision, finite movements of the valve plug. In one embodiment, a linear DC servo motor is utilized that comprises a solid stator housing, a coil assembly, and a multipole magnetic forcer rod.

Figure 6A:
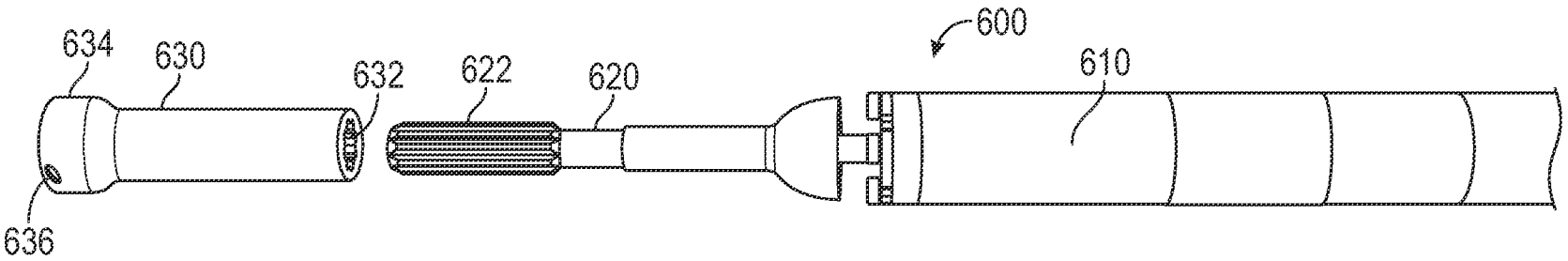
FIG. 6A illustrates a drive train of the disclosed valve assembly according to one embodiment of the present disclosure.
Figure 6B:
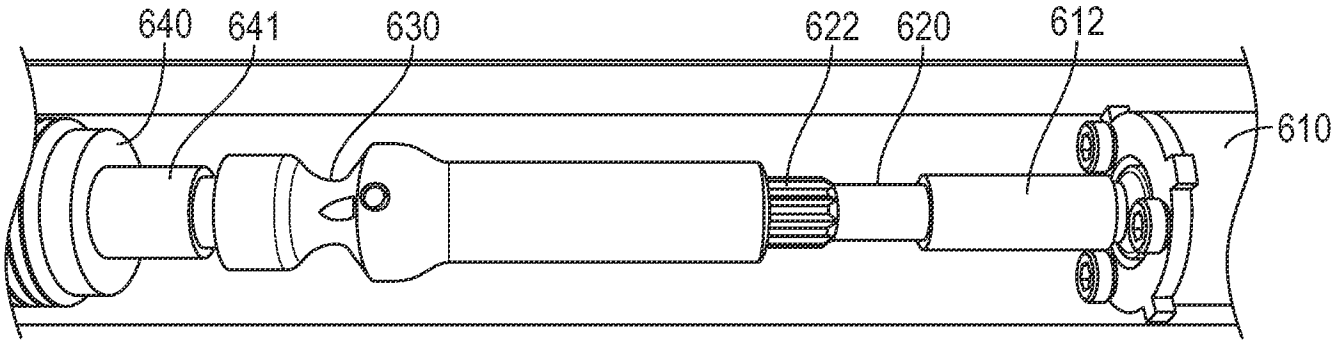
FIG. 6B illustrates the drive train of FIG. 6A coupled to a valve plug according to one embodiment of the present disclosure.

FIG. 6A illustrates one embodiment of a drive train of the disclosed valve assembly in a partially exploded view, while FIG. 6B illustrates the drive train in an assembled configuration and coupled to a portion of the valve plug. In one embodiment, the drive train comprises a DC motor coupled to a gearhead that powers a threaded drive plug. For example, drive train 600 comprises motor 610 and one or more drive shafts 620, 630 coupled to motor 610. In one embodiment, a first portion of first drive shaft 610 is coupled to member 612 of motor 610, and a second portion of first drive shaft 620 is coupled to second drive shaft 630. The second portion of the first drive shaft is male spline 622 that mates with female spline 632 of second drive shaft 630. In one embodiment, as motor bushing 612 rotates (see FIG. 6B), first drive shaft 620 rotates, which then rotates second drive shaft 630. The use of the male and female splined portions of the drive shafts allow longitudinal movement of the drive shaft(s) within the valve assembly for corresponding movement of the valve plug between an open and closed position. In other embodiments, the first and second drive shafts can be replaced by a single drive shaft embodiment.

In one embodiment, a front portion of second drive shaft 630 is configured with receiving end 634 to mate with and/or receive valve plug 640. For example, the valve plug may be a dart with shaft portion 641 that is inserted into receiving end 634 of drive shaft 630. In one embodiment, receiving end is configured in a shape to receive the dart end and comprises a locking hole/pin 636 to securely attach the dart shaft to the drive shaft. Based on this attachment, rotation of the drive shaft(s) rotate dart 640.

Figure 6C:
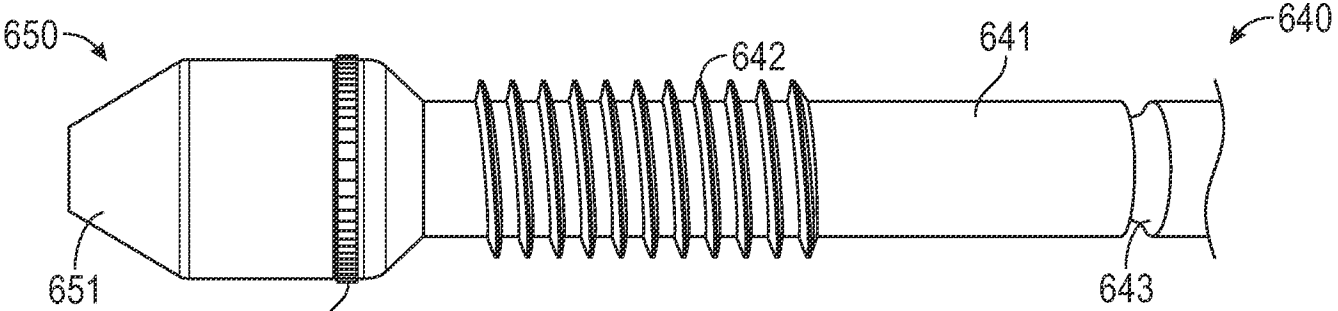
FIG. 6C illustrates one embodiment of a valve plug that may be used with the drive train of FIG. 6A according to one embodiment of the present disclosure.

FIG. 6C illustrates a valve plug according to one embodiment of the present disclosure. Valve plug 640 may comprise an elongated dart with head portion 650 and shaft portion 641. The tail of the shaft may have concentric groove 643 for coupling with the drive shaft. Head portion 650 may comprise angled surfaces 651 that seal against an inlet or outlet port and/or a valve seat within the valve chamber of the valve assembly (not shown). Head portion 650 may also comprise one or more sealing elements 653, which may be disposed in a concentric groove around the head. Dart 640 may also comprise worm gear having external threads 642 that mate with an internal thread (not shown) formed by a portion of the valve housing. As may be appreciated by one of skill in the art, rotation of the drive shaft causes rotation of the dart, and the dart is axially moved based on the worm gear portion. Thus, dart 640 may be actuated to open and close the ports within the valve assembly and valve opening 12 of the tubing sub/tubing string.

The configuration of the inlet and outlet ports for the valve assembly—and their interaction and/or sealing surface with the valve plug—may take a number of different embodiments. While one embodiment discloses a dart that seals against a lateral port and an axial port (see, e.g., FIG. 4A), other configurations are possible within the scope of this invention based upon the intended operation/use of the valve, certain downhole conditions, and/or valve plug design. As more fully detailed below, FIGS. 7A-7H illustrate various embodiments of a portion of a valve assembly according to the present disclosure with variations of the inlet/outlet ports and valve plug head—and interactions thereof—that generally may be used with the rest of the valve assembly components as described herein. In general, the disclosed valve plug may be any flow control member that blocks the inlet and outlet ports and/or is moveable to close and/or open the valve.

Figure 7C:
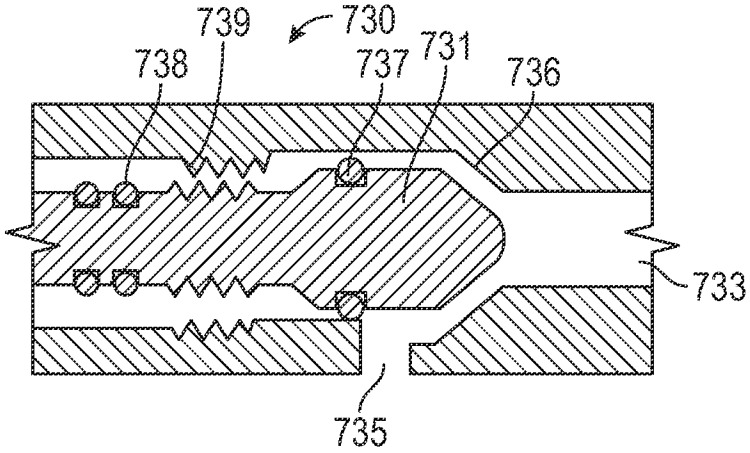
FIGS. 7A-7H illustrate various embodiments of a valve plug according to the present disclosure.
Figure 7D:
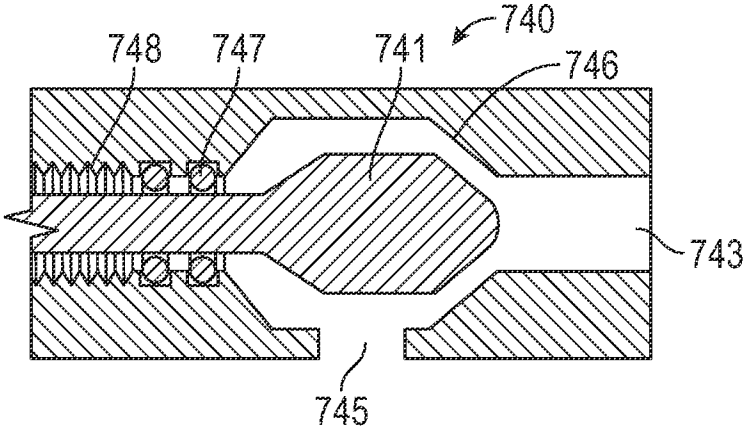
Figure 7A:
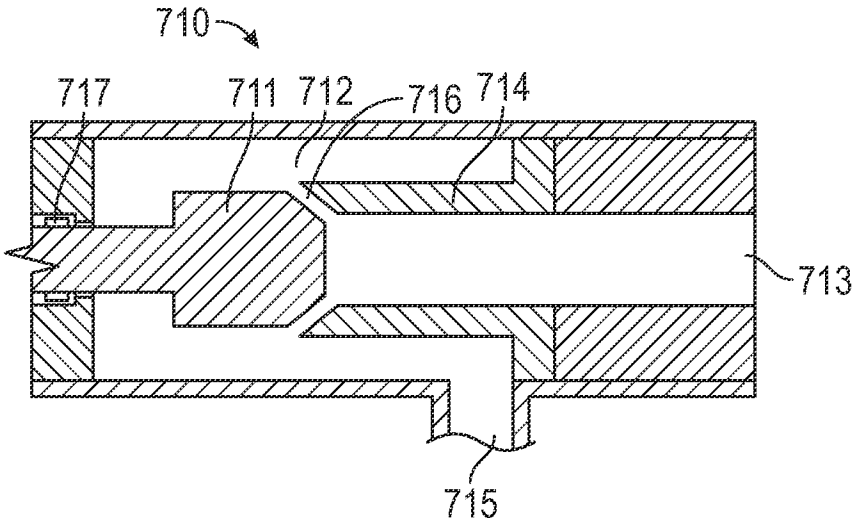

FIG. 7A illustrates an embodiment wherein a head of the valve plug directly seals against the main passage of the valve but not against a lateral port. In this embodiment, an inner cavity housing 714 extends from main passage 713 into valve cavity 712. Main passage 713 is located on an axial portion of an end of valve assembly 710 and is in fluid communication exterior to the tubing string, such as the annulus of the borehole. Head portion 711 of the valve plug mates against seating surface 716 of inner cavity housing 714. Such a seal closes flow through main passage 713. A shaft portion of the valve plug has one or more seals 717 that prevents fluid flow into the remaining interior portions of valve assembly 710. While lateral port 715 opens into inner cavity 712, the valve port is not directly coupled to and does not seal against the valve plug based on the location of inner housing 714 and plug head 711. In other words, the valve plug closes main passage 713 but does not directly close lateral port 715. In one embodiment, lateral port 715 is positioned proximate to (and in fluid connection with) a valve opening on the tubing sub (such as valve opening 12). Head portion 711 of the valve plug has a front surface that is substantially angled and a rear surface that is substantially flat.

Figure 7B:
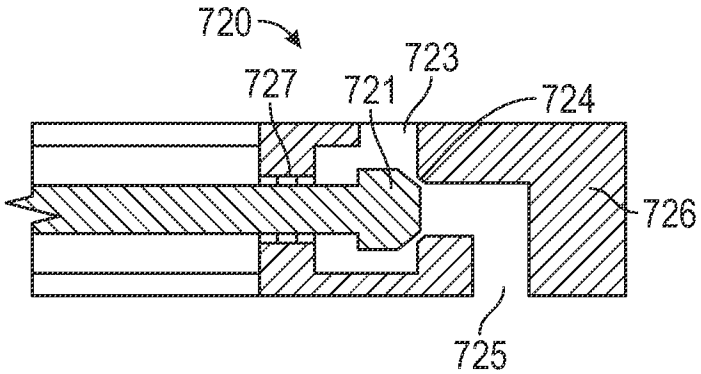

FIG. 7B illustrates an embodiment with a plurality of lateral ports instead of an axial port. In this embodiment, lateral port 725 may be positioned proximate to (and in fluid connection with) a valve opening on the tubing sub (such as valve opening 12). Main passage 723 is located on a lateral portion of the valve assembly and is in fluid communication exterior to the tubing string, such as the annulus of the borehole. In one embodiment, main passage 723 and lateral port 725 are on opposite sides of the valve assembly. Valve plug 720 has one or more seals 727 that prevents fluid flow into the remaining interior portions of the valve assembly. Head portion 721 of the valve plug mates against seating surface 724 of valve housing 726. Head portion 721 of the valve plug has a front surface that is substantially angled and a rear surface that is substantially flat.

FIG. 7C illustrates an embodiment of valve assembly 730 with axial port 733 and lateral port 735. In this embodiment, axial port 733 may be in fluid communication exterior to the tubing string and lateral port 735 may be in fluid communication interior to the tubing string (such as through valve opening 12). Head portion 731 of the valve plug mates against angled seating surface 736 of the valve assembly housing. The head portion of the valve plug may have one or more sealing elements 737 (such as an O-ring) and a lower portion of the valve plug (such as the shaft of the plug) may have one or more sets of sealing elements 738. Between the first and second sealing elements may exist one or more threaded sections 739 on the valve plug and/or the valve assembly housing. Threaded sections 739 may comprise a worm screw (with corresponding threads on an inside surface of the valve housing and the outer surface of the valve plug) for actuation of the valve plug between different axial positions, such as a substantially closed position and a substantially open position. In other embodiments described herein, these threaded sections may exist lower down on the shaft portion of the valve plug. Head portion 731 of the valve plug has a front surface that is substantially angled and a rear surface that is substantially angled, with sealing elements 738 located on the head between the front and rear angled sections.

FIG. 7D illustrates an embodiment of valve assembly 740 with axial port 743 and lateral port 745. This embodiment may be substantially similar to valve assembly 730 disclosed in FIG. 7C. In this embodiment, axial port 743 may be in fluid communication exterior to the tubing string and lateral port 745 may be in fluid communication interior to the tubing string (such as through valve opening 12). Head portion 741 of the valve plug mates against angled seating surface 746 of the valve assembly housing. Similar to valve assembly 730, the valve plug may have one or more sealing elements 747 (such as an O-ring) proximate to worm screw/threaded section 748. Head portion 741 of the valve plug has a front surface that is substantially angled and a rear surface that is substantially angled, with a substantially straight portion between the front and rear surfaces of the head. In contrast to FIG. 7C, the embodiment described in FIG. 7D does not have seals on the head portion of the valve plug.

Figure 7E:
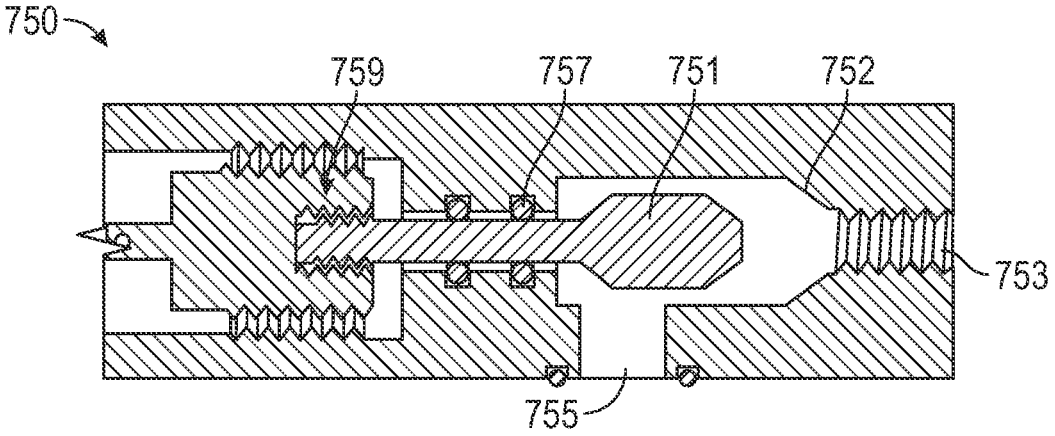

FIG. 7E illustrates an embodiment of valve assembly 750 with axial port 753 and lateral port 755. In this embodiment, axial port 753 may be in fluid communication exterior to the tubing string and lateral port 755 may be in fluid communication interior to the tubing string (such as through valve opening 12). Head portion 751 of the valve plug mates against tapered seat 752 that threads into axial port 753. The valve plug may have one or more sealing elements 757 on a shaft portion of the valve plug. A set of sealing elements may also be located around lateral port 755. A lower portion of the shaft may be coupled to spindle 759 via one or more threads, and spindle 759 may be coupled to an outer housing of the valve assembly by one or more threads. In one embodiment, spindle 759 may be actuated to move valve plug 751 to a closed and/or open position. Head portion 751 of the valve plug has a front surface that is substantially angled and a rear surface that is substantially angled, with a substantially straight portion between the front and rear surfaces of the head. In this embodiment, a diameter of the valve plug head may be approximately ½" and a diameter of the valve plug shaft may be approximately ¼".

Figure 7F:
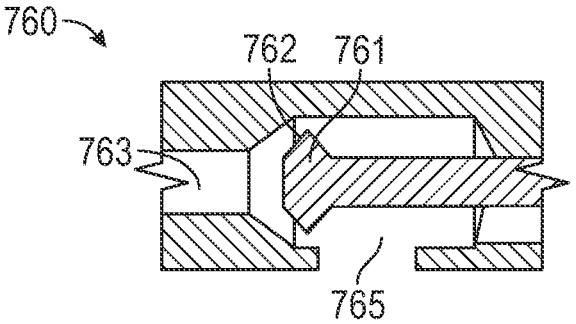

FIG. 7F illustrates an embodiment of valve assembly 760 with axial port 763 and lateral port 765. In this embodiment, axial port 763 may be in fluid communication exterior to the tubing string and lateral port 765 may be in fluid communication interior to the tubing string (such as through valve opening 12). Head portion 761 of the valve plug mates against an angled sealing surface of the valve housing. Head portion 761 of the valve plug has a front surface that is substantially angled and a rear surface that is substantially angled that meet at head portion 762. In this embodiment, a diameter of the shaft may be smaller than a diameter of main passage 763. For example, a diameter of the shaft may be approximately ¼" and a diameter of the passage may be approximately ⅜".

Figure 7G:
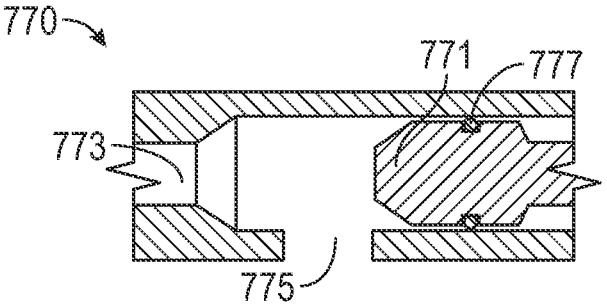

FIG. 7G illustrates an embodiment of valve assembly 770 with axial port 773 and lateral port 775. In this embodiment, axial port 773 may be in fluid communication exterior to the tubing string and lateral port 775 may be in fluid communication interior to the tubing string (such as through valve opening 12). Head portion 771 of the valve plug mates against an angled sealing surface of the valve housing. Head portion 771 of the valve plug has a front surface that is substantially angled and a rear surface that is substantially angled, with sealing elements 777 located between the front and rear angled surfaces along a substantially straight portion of the valve plug head. In this embodiment, a diameter of the head may be larger than a diameter of main passage 773. For example, a diameter of the head 771 may be approximately ½" and a diameter of the passage may be approximately ⅜".

Figure 7H:
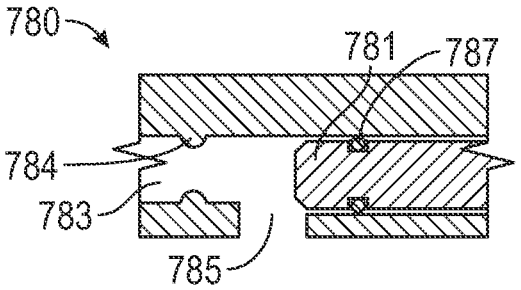

FIG. 7H illustrates an embodiment of valve assembly 780 with axial port 783 and lateral port 785. In this embodiment, axial port 783 may be in fluid communication exterior to the tubing string and lateral port 785 may be in fluid communication interior to the tubing string (such as through valve opening 12). Head portion 781 of the valve plug mates against an angled sealing surface of the valve housing. Head portion 781 of the valve plug has a front surface that is substantially angled and one or more sealing elements 787 adjacent the front surface of the head. One or more sealing elements or protrusions 784 may be located within an interior portion of the valve housing that seal against and/or mate with the angled surfaces of the valve plug head 781. In this embodiment, a diameter of the head may be approximately the same diameter as the main passage 783. For example, a diameter of the head 781 may be approximately ⅜" and a diameter of the passage may be approximately ⅜". The main passage is able to be closed by the interaction of protrusion or sealing surface 784 with head 781.

In one embodiment, the valve plug functions to partially and/or fully seal fluid flow through the valve assembly. This function can be met by any number of different configurations of the valve plug. In one embodiment, the valve plug may be an elongated dart, which has a head portion (which may be considered as the dart tip) and a tail portion (which may be considered as the dart shaft). In one embodiment, the valve plug operates as a flow control member and the disclosed valve is a flow control valve. In other embodiments, the valve plug may be a needle valve, a ball valve, or a knife valve. The dart may generally comprise a head section and a tail section. In one embodiment, the tail section may be a shaft that is coupled directly or indirectly to a motor or drive train. The head section of the valve plug may seal against one or both of the inlet and outlet ports to the valve assembly. The dart may have one or more threaded sections and may comprise a worm gear and/or a ball screw. In one embodiment, the dart may have one or more sealing systems (e.g., O-rings) on a shaft portion of the dart and/or the head portion of the dart.

In one embodiment, the dart tip or head mates with a sealing face of the valve housing that surrounds an exterior passage or opening to the valve assembly, which may be considered the valve seat. To prevent fluid flow through the main passage (and to regulate flow through the main passage) and to position the valve in a substantially closed position, the contact surfaces of the dart tip must sealing engage with the valve seat. Such a sealing arrangement may be performed by any number of different arrangements, including different faces, shapes, and materials of the dart tip and the corresponding valve seat.

The valve plug can be formed of a wide variety of materials. For example, the dart may be made of both metallic and non-metallic materials. For example, a shaft portion of the dart may be substantially metallic (e.g., stainless steel), and the head portion of the dart may be substantially plastic, such as any number of thermoplastics or elastomers. In other embodiments, the head portion may be a different metallic material (e.g., brass or Inconel) than the shaft portion. In some embodiments, the dart tip may be substantially non-metallic and the valve seat may be substantially metallic, while in other embodiments the dart tip may be substantially metallic and the valve seat may be substantially non-metallic, while in still other embodiments both the dart tip and valve seat may be substantially metallic or non-metallic.

FIGS. 8A-8D illustrate various embodiments of a valve plug according to the present disclosure. As described in these figures, the head portion may have various configurations, including substantially flat and/or angled sealing surfaces. In these embodiments, the main passage is an axial port and the lateral port is not illustrated. Further, as described in FIGS. 7A-7H, the valve plug may interact with the inlet and outlet openings to the valve assembly by different mechanisms. In one embodiment, the valve plug may be larger than the exterior passage to the valve, and in other embodiments, the valve plug may be the same or smaller diameter than the exterior passage.

Figure 8A:
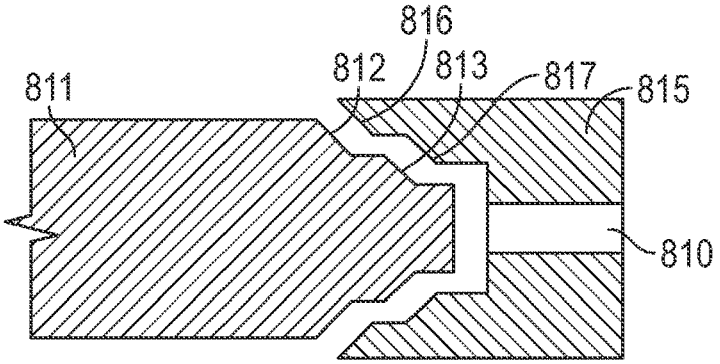
FIGS. 8A-8D illustrate various embodiments of a valve plug according to the present disclosure.

FIG. 8A illustrates a schematic of a head portion of a valve plug (such as a dart) according to one embodiment of the present disclosure. In this embodiment, head portion 811 is substantially cylindrical and comprises a plurality of angled surfaces that are concentric around an end section of head 811. For example, head 811 comprises first angled surface 812 and second angled surface 813, each of which forms a contact and/or mating surface to seal corresponding surfaces 816, 817 on valve housing 815. The use of multiple sealing surfaces provides corrosion and abrasion resistance, which can be problematic in downhole conditions. In one embodiment, the main exterior passage 810 to the valve assembly is located substantially in the center of housing 815.

Figure 8B:
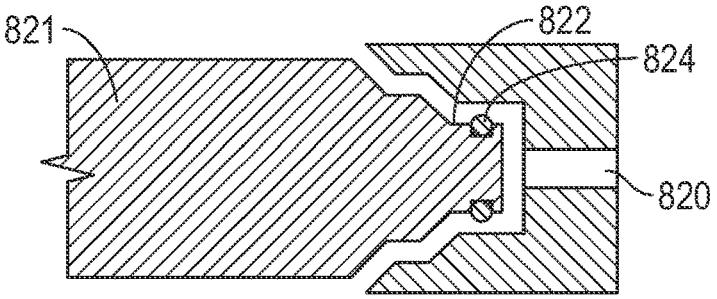

FIG. 8B illustrates a schematic of a head portion of a valve plug (such as a dart) according to another embodiment of the present disclosure. This embodiment is substantially similar to the embodiment of FIG. 8A (and thus excludes many items from FIG. 8A for simplicity) but includes one or more sealing elements 824 (e.g., O-rings) on head 821. Sealing element 824 may be located on one of the contact surfaces of the head or may be located on one of the adjacent surfaces such as substantially straight section 822. In this embodiment, sealing element 824 provide corrosion and abrasion resistance.

Figure 8C:
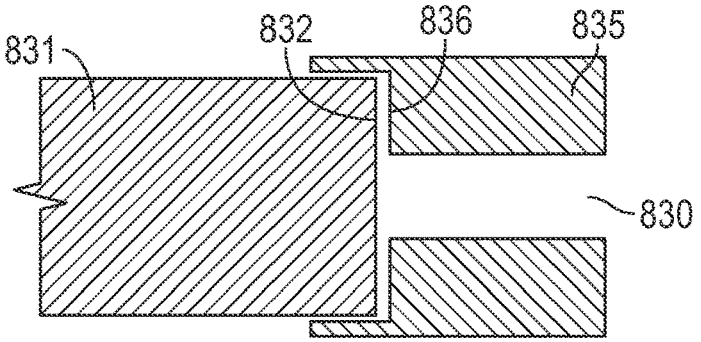

FIG. 8C illustrates a schematic of a head portion of a valve plug (such as a dart) according to another embodiment of the present disclosure. In this embodiment, head portion 831 is substantially cylindrical and comprises a substantially flat surface, such that head flat surface 832 contacts and/or seals against housing flat surface 836 to seal against fluid flow through passage 830. In one embodiment, an outer portion of housing 835 surrounds a portion of dart 831 in a closed position.

Figure 8D:
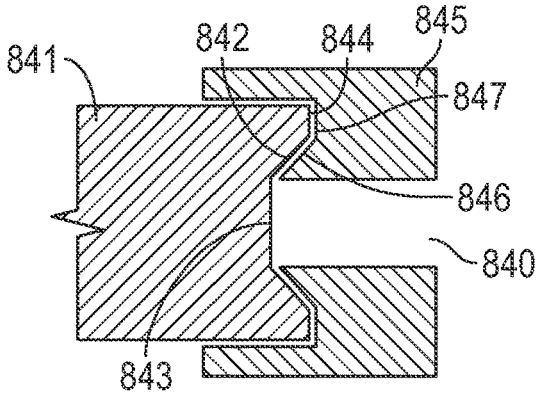

FIG. 8D illustrates a schematic of a head portion of a valve plug (such as a dart) according to another embodiment of the present disclosure. In this embodiment, head portion 841 is substantially cylindrical and comprises a combination of flat and angled sealing surfaces. For example, the end portion of head 841 comprises flat portion 843 that mates with main passage 840 of housing 845. Other portions of head 841 comprise angled surface 842 that mates with angled surface 846 of housing 845 and flat surface 844 that mates with flat surface 847 of housing 845.

In operation, the disclosed valve assembly may be used to monitor and/or control any injection and/or production operation of a downhole operation. In one embodiment, multiple valve assemblies may be remotely controlled downhole via a single control line connecting each of the valve assemblies. Injection or stimulation operations may include, but are not limited to, enhanced oil recovery (EOR), carbon dioxide ($CO_2$) injection, artificial gas lift, and automated oil and gas production. Production operations may include optimizing the flow of oil and/or gas through various downhole valves placed between stimulated intervals in zones or compartments (such as those separated by packers). For example, the disclosed valve may be configured to detect water flowing through the valve assembly and thus in certain embodiments can shut off water producing compartments to keep oil or gas production flowing to the surface. In the inverse operation, such as for an EOR scenario, the disclosed valve assembly may be configured to inject water, gas, or oil into a particular compartment (such as one separated from other zones or compartments by one or more packers) effectively by shutting off over injected compartments by the detection of water break through. In one embodiment, the determination of which valve to inject the desired fluid into is derived by the pressure and temperature sensors located within the valve assembly, whether they are located on the inner diameter or the outer diameter of the valve. This sensor data provides the valve assembly and/or remote operator the ability to sweep or inject the desired fluid (e.g., water, gas, carbon dioxide) into the desired zone and at what total % percentage. Similarly, artificial lift operations may include placing the desired number of valve assemblies (such as up to 30) along the tubing string within the production casing. Each valve may be open and/or closed based on pressure measurements by sensors within the valve assembly. In one embodiment, each of these disclosed operations, and in particular the artificial lift operation, is based on logic within the valve assembly and the sensor measurements derive the position of the valve inlet and/or outlet.

Figure 9:
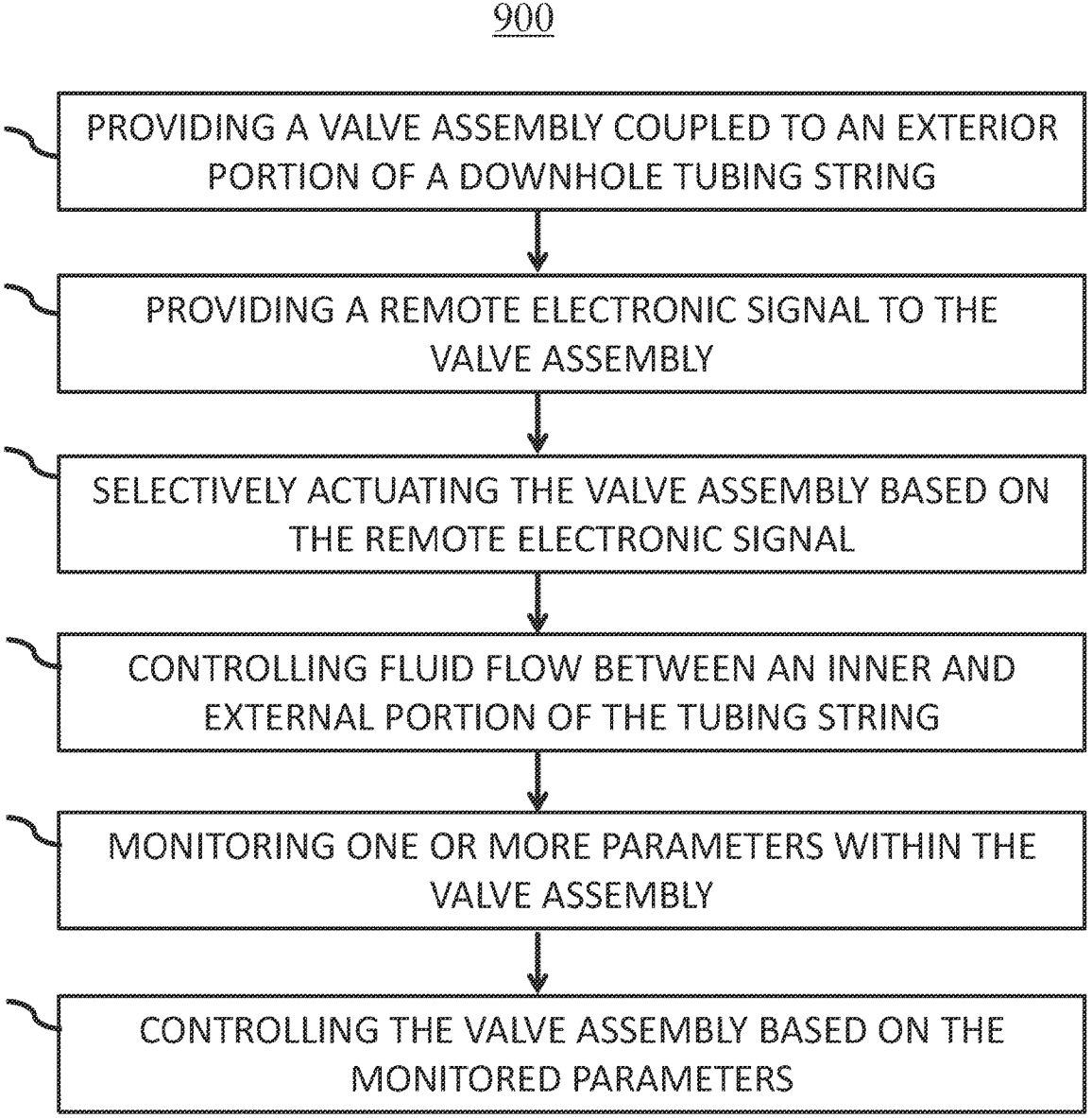
FIG. 9 illustrates one method for operating a downhole valve according to one embodiment of the present disclosure.

FIG. 9 illustrates one exemplary method 900 to operate a downhole valve as disclosed herein. The method may be utilized in any injection or production operation as described herein. Step 902 comprises providing a valve assembly coupled to an exterior portion of a tubing string. In one embodiment, the valve assembly may be coupled to a tubing sub which is coupled to the tubing string by threaded joints. The valve assembly may be in fluid communication with an interior portion of the tubing string. The valve assembly may comprise a first port (such as a lateral port) in fluid communication with an inlet opening to the tubing string and a second port (such as an axial port) in fluid communication external to the tubing string (such as an annulus of the borehole). In other embodiments, a production liner, slotted liner, or coiled tubing may be utilized instead of a tubing string.

Step 904 comprises providing a remote electronic signal to the valve assembly. In one embodiment, the valve assembly is coupled to a TEC cable (which may be coupled to other downhole valves positioned on the tubing string) that connects the valve assembly to a remote location, such as at the surface to the borehole. Such a surface station may provide data and/or power to the TEC cable and thus to the valve assembly. The surface station may be coupled to a wireless system that allows further data transmission with the valve assembly for further remote operation, control, and/or monitoring. For example, an operator may be able to remotely control signals to the valve assembly via any remote device, such as a handheld device, smart phone, computer, or any other Internet enabled device. The remote electrical signals may comprise commands to the valve assembly or data from the valve assembly in response to various sensors or other signals from the valve assembly. In one embodiment, the valve assembly comprises an electronics section with the necessary control boards and motor controllers that can receive any data and/or electronic commands from a remote location to control the valve assembly. Thus, the valve assembly may be electronically activated and controlled from the surface without having to enter the well with any additional tools. While a portion of the operations of the downhole valve assembly may be performed automatically and/or independent within the electronics of the valve assembly itself, some of the target points or control points may be provided by the remote location.

Step 906 may comprise selectively actuating the valve assembly based on the remote electronic signal. In one embodiment, actuation of the valve assembly comprises moving the valve plug (e.g., dart) axially the desired distance to open or close either (or both) the inlet and outlet ports of the valve assembly. In one embodiment, axial movement of the dart is caused by rotation of one or more drive shafts within the valve assembly that are coupled to the dart. In one embodiment, remote signals from the surface may be communicated to a motor controller or control board of the valve assembly, which then may be communicated to a motor of the valve assembly for actuation of the valve assembly. In one embodiment, the valve assembly is able to react near instantaneously to surface (remote) commands. As described herein, the valve assembly may be actuated between a closed position and an open position (and vice versa), and any position between a substantially open and closed position. For example, if the valve assembly wanted to be open to set point of 26%, the valve could be actuated (whether opened or closed) until the valve assembly is open 26% as measured by an electronic encoder. In one embodiment, the valve assembly may be selectively actuated to a certain parameter, whether that parameter is flow rate, temperature, pressure, and/or valve position.

Step 908 may comprise controlling the fluid flow between an internal portion or cavity of the tubing string and an external portion of the tubing string. For example, as described herein, a valve assembly may be positioned within a tubing sub with a valve opening that is coupled to a downhole tubing string. Actuation and/or control of the valve assembly thereby controls fluid flow through the valve opening. In one embodiment, one of the passages/openings of the valve assembly is in fluid communication with an exterior portion of the tubing string, such as the annulus of the borehole. Thus, control of the valve assembly allows fluid flow control between the annulus of the tubing string and the inner portion of the tubing string. Such a configuration of the disclosed valve assembly allows a wide variety of downhole fluid operations, such as injecting fluid into tubing string through the annulus, or producing fluids from the tubing string out through the valve assembly.

In some embodiments, step 910 may comprise monitoring one or more parameters based on the actuation step. For example, any one or more downhole parameters may be monitored, such as flow rate, temperature, pressure, and/or valve position. In one embodiment, the valve assembly may comprise one or more integrated sensors that detects one or more downhole parameters and then sends electrical signals through a TEC cable up to the surface and/or other remote location. During the operation of the valve assembly, parameters can be continually monitored in real-time for each valve assembly and communicated to a remote location via the TEC cable. Thus, an operator may be able to view—in real time—zonal fluctuations within the borehole as the occur and take corrective and immediate action. In some embodiments, the valve assembly may be configured to automatically regulate and/or control itself based on the measured parameters. In one embodiment, the valve assembly (via one or more sensors) provides positive feedback and known orientation of the valve. In some embodiments, the sensors may be located within the valve assembly itself or merely adjacent to the valve. Likewise, the sensors may measure a parameter inside of the valve assembly, exterior to the tubing string, or interior to the tubing string.

In some embodiments, step 912 may comprise controlling the valve assembly based on any signals received in response to the monitoring step. For example, if a particular fluid flow rate is desired, the valve may be opened to a certain initial valve position. A valve assembly sensor may measure the flow rate through the valve based on this initial valve position and then automatically move and/or control the valve to a different valve position to achieve the desired fluid flow rate. Such control may be performed within the valve assembly itself with the necessary control logic programming without having to send signals back and forth between a remote location. In other words, once a particular parameter is set for the valve assembly, the valve assembly is configured to achieve that parameter for the desired time or until a different parameter is provided. Thus, in one embodiment, the disclosed valve assembly is able to provide continuously variable flow control based upon real-time measured data. In one embodiment, if water or gas is detected in the fluid flow (or if some other desired parameter is measured), the valve assembly may be programmed to automatically close to reduce the unwanted fluid.

As disclosed herein, multiple downhole valves may be coupled to a single control line and actuated, controlled, and/or monitored by a remote location. In such an embodiment, each of the downhole valves may be used independently similar to those steps described above in relation to method 900. In other words, while method 900 is generally related to a single valve, such steps are equally related to the use of a plurality of downhole valves as described herein.

As can be appreciated, the disclosed valve assembly and operation thereof provides numerous benefits. It allows for bi-directional flow through the valve assembly; in other words, the operator may control inflow and outflow through the valve assembly. The disclosed valve assembly allows for full and infinite control over the valve assembly and fluid flow through the tubing string. The disclosed valve assembly provides an adjustable, quick-response, and electric flow control valve that is fully controllable from a remote location. It allows for optimal production and recovery of downhole operations by the real-time, continuous, individual, and simultaneous management and control of multiple valve assemblies. Thus, multiple zones (including additional lateral or horizontal wells) may be continuously measured in real time. A single electrical control line may be coupled to each downhole valve assembly, which allows bi-directional telemetry data for diagnostics, control, and measurements for all of the downhole valves without requiring a hydraulic control line or separate lines for each valve. As can be appreciated, such control reduces overall operating costs for the well, including time, cost, and risk reduction by minimizing well interventions, and enhances oil recovery and reduces the decline in oil or gas production for a well.

All of the methods disclosed and claimed herein can be made and executed without undue experimentation in light of the present disclosure. While the apparatus and methods of this invention have been described in terms of preferred embodiments, it will be apparent to those of skill in the art that variations may be applied to the methods and in the steps or in the sequence of steps of the method described herein without departing from the concept, spirit and scope of the invention. In addition, modifications may be made to the disclosed apparatus and components may be eliminated or substituted for the components described herein where the same or similar results would be achieved. All such similar substitutes and modifications apparent to those skilled in the art are deemed to be within the spirit, scope, and concept of the invention.

Many other variations in the system are within the scope of the invention. For example, the disclosed valve assembly may be coupled to a tubing sub in any number of configurations. As another example, while one embodiment of the disclosed valve assembly is directed to jointed tubing and the use of tubing subs, the disclosed valve assembly may not require a tubing sub in some embodiments. Further, the disclosed valve assembly maybe coupled to other downhole tools or equipment, such as production liners, slotted liners, and coiled tubing. Still further, the disclosed valve assembly does not depend on any particular arrangement of a valve plug, dart, sensor, motor, drive train, and/or configuration of inlet and outlet openings. Likewise, any variety of dart and/or valve plug configurations and valve seat designs may be utilized within the scope of the present disclosure. It is emphasized that the foregoing embodiments are only examples of the very many different structural and material configurations that are possible within the scope of the present invention.

Although the invention(s) is/are described herein with reference to specific embodiments, various modifications and changes can be made without departing from the scope of the present invention(s), as presently set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

What is claimed is:

1. A downhole valve, the valve comprising:

an electric motor;

a motor controller coupled to the electric motor;

at least one sensor;

a flow control member moveable between a plurality of valve positions within the valve, wherein the motor is configured to move the flow control member based on measurements provided by the at least one sensor, wherein the motor controller is configured to control axial movement of the flow control member in the axial direction in a continuously variable mode such that the flow control member linearly moves in the axial direction to a plurality of continuously variable positions between a fully closed position and a fully open position; and wherein the flow control member is configured to be automatically adjusted by the motor controller based on one or more measured parameters from the at least one sensor, wherein the valve is configured for controlling fluid flow between an interior portion of a tubing string of a wellbore and an annulus of the tubing string.

2. The valve of claim 1, wherein the motor controller comprises a digital encoder.

3. The valve of claim 2, wherein the digital encoder provides information to the motor controller based on measurements from the at least one sensor.

4. The valve of claim 1, further comprising a circuit board coupled to the motor controller and the at least one sensor.

5. The valve of claim 1, wherein the motor controller is responsive to electronic signals from a remote location.

6. The valve of claim 1, wherein the flow control member is coupled to the electric motor by a drive shaft.

7. The valve of claim 1, wherein the valve is configured to be set to a particular open percentage.

8. The valve of claim 1, wherein an opening of the valve is adjustable to a particular open percentage.

9. The valve of claim 1, wherein the valve is configured to be set at a desired valve opening setpoint.

10. The valve of claim 1, wherein movement of the flow control member controls an orifice size of the valve.

11. The valve of claim 1, wherein the flow control member is configured to be manually adjusted from electronic signals provided at a remote location based on one or more measured parameters from the at least one sensor.

12. The valve of claim 1, wherein a position of the flow control member is adjustable by information provided by the motor controller.

13. The valve of claim 1, wherein the valve is configured to be set to a closed position or an open position based on one or more measured parameters from the at least one sensor.

14. The valve of claim 1, wherein the flow control member is configured for incremental control of fluid flow through the valve.

15. The valve of claim 1, wherein the flow control member is configured for incremental movement based on signals provided by the motor controller.

16. The valve of claim 1, wherein the flow control member is configured for incremental movement based on signals provided by the at least one sensor.

17. The valve of claim 1, wherein the at least one sensor comprises a pressure sensor.

18. The valve of claim 1, wherein the at least one sensor comprises an integrated pressure and temperature sensor.

19. The valve of claim 1, wherein the at least one sensor comprises a first sensor configured to measure annular tubing pressure and a second sensor configured to measure internal tubing pressure.

20. The valve of claim 1, further comprising a position sensor that provides positive feedback of a position of the flow control member.

21. The valve of claim 1, wherein the valve is configured to provide continuous measurements from the at least one sensor to the motor controller.

22. The valve of claim 1, further comprising an inlet port and an outlet port, wherein the flow control member is located in a valve chamber between the inlet port and the outlet port, wherein the inlet port is in fluid communication with the outlet port when the flow control member is an open position.

23. The valve of claim 1, wherein the flow control member comprises a valve plug or dart.

24. The downhole valve of claim 1, further comprising a tubing sub having a substantially cylindrical primary bore and a sub port and adapted to be in fluid communication with the tubing string of the wellbore, wherein an inlet of the valve is in fluid communication with the sub port and an interior portion of the tubing sub, wherein an outlet of the valve is in fluid communication with an exterior portion to the tubing sub, wherein the valve is adapted to control fluid flow between the sub port and the outlet of the valve assembly.

25. The valve of claim 1, wherein the wherein the valve is configured to be coupled to an exterior portion of the tubing string.

26. A downhole valve system, the system comprising:

a tubing sub with a valve opening in an exterior wall of the tubing sub, wherein the tubing sub comprises a substantially cylindrical primary bore and sub port, wherein the valve sub is in fluid communication with a tubing string of a wellbore;

a valve assembly coupled to the tubing sub, wherein the valve assembly comprises an electric motor, a motor controller, one or more sensors, a first port, a second port, and a flow control member moveable between a plurality of incremental positions within the valve assembly, wherein the first port of the valve assembly is in fluid communication with the sub port and an interior portion of the tubing sub, wherein the second port of the valve assembly is in fluid communication with an exterior portion to the tubing sub, wherein the valve assembly is configured to control fluid flow between an interior portion of the tubing string and an annulus of the tubing string, wherein the motor controller is adapted to control axial movement of the flow control member in the axial direction in a continuously variable mode such that the flow control member linearly moves in the axial direction to a plurality of continuously variable positions between a fully closed position and a fully open position, wherein the flow control member is configured to be automatically adjusted by the motor controller based on one or more measured parameters from the at least one sensor.

27. The system of claim 26, wherein the first port is a lateral port and the second port is an axial port.

28. The system of claim 26, wherein the at least one sensor comprises an integrated pressure and temperature sensor.

29. The system of claim 26, wherein the at least one sensor comprises a first sensor configured to measure annular tubing pressure and a second sensor configured to measure internal tubing pressure.

30. The system of claim 26, wherein the at least one sensor comprises a first sensor fluidly coupled to an inside portion of the valve assembly and a second sensor fluidly coupled to an inside portion of the tubing string.

31. A method of operating a downhole valve, comprising:

providing a downhole valve coupled to a tubing string, wherein the downhole valve comprises an electric motor, a motor controller, a flow control member, and one or more sensors, wherein the downhole valve comprises a plurality of continuously variable positions between a fully open position and a fully closed position;

monitoring one or more downhole parameters with the one or more sensors;

controlling an opening of the valve assembly based on the monitored downhole parameters from the one or more sensors;

producing an axial movement of the flow control member;

positioning the flow control member to a predetermined one of the plurality of continuously variable positions based on the monitored downhole parameters from the one or more sensors; and controlling fluid flow through the valve assembly between an inner portion of the tubing string and an annulus of the tubing string.

32. The method of claim 31, wherein the controlling step comprises providing electronic signals by the motor controller to the motor based on measurements from the one or more sensors.

33. The method of claim 31, further comprising controlling a fluid flow rate through the downhole valve based on signals provided by the motor controller.

34. The method of claim 31, further comprising actuating the motor based on signals provided by the motor controller.

35. The method of claim 31, further comprising actuating the motor based on signals provided by the one or more sensors.

36. The method of claim 31, further comprising setting a desired parameter for the valve assembly and controlling an opening percentage of the valve assembly to achieve the desired parameter.

37. The method of claim 31, wherein the controlling step comprises automatically adjusting a valve opening within the valve assembly based on one or more monitored parameters.

38. The method of claim 31, wherein the monitored parameters comprises at least pressure and temperature.

39. The method of claim 31, wherein the monitored parameters comprises a valve opening of the valve assembly.

40. The method of claim 31, further comprising providing positive feedback to the motor controller of an opening of the valve assembly.

41. The method of claim 31, wherein the controlling step is performed automatically by the motor controller.

42. The method of claim 31, wherein the controlling step is performed manually by electronic signals from a remote location.

43. The method of claim 31, wherein the downhole valve comprises a flow control member, further comprising selectively actuating the electric motor to move the flow control member to a desired valve opening.

44. The method of claim 43, wherein the actuating step comprises moving the flow control member between a closed position and an open position within the valve assembly based on the monitored downhole parameters.

* * * * *